US011512887B2

(12) United States Patent
Jeon et al.

(10) Patent No.: US 11,512,887 B2
(45) Date of Patent: Nov. 29, 2022

(54) REFRIGERATOR

(71) Applicant: SAMSUNG ELECTRONICS CO., LTD., Suwon-si (KR)

(72) Inventors: Byung Woo Jeon, Suwon-si (KR); Il Sung Bae, Suwon-si (KR); Dae Jin Hong, Suwon-si (KR); Sun Gi Hong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 294 days.

(21) Appl. No.: 16/715,585

(22) Filed: Dec. 16, 2019

(65) Prior Publication Data

US 2020/0200462 A1 Jun. 25, 2020

(30) Foreign Application Priority Data

Dec. 19, 2018 (KR) ..... 10-2018-0165556

(51) Int. Cl.

| | |
|---|---|
| ***F25D 17/08*** | (2006.01) |
| ***F25D 17/06*** | (2006.01) |
| ***F25D 11/02*** | (2006.01) |
| ***F25D 17/04*** | (2006.01) |

(52) U.S. Cl.

CPC ..... *F25D 17/065* (2013.01); *F25D 11/022* (2013.01); *F25D 17/045* (2013.01); *F25D 17/067* (2013.01); *F25D 17/08* (2013.01)

(58) Field of Classification Search

CPC ..... F25D 11/022; F25D 17/065; F25D 19/02

See application file for complete search history.

(56) References Cited

U.S. PATENT DOCUMENTS 5,417,079 A * 5/1995 Rudick ..... A47F 3/0408 62/253
7,231,782 B2 * 6/2007 Jung ..... F25D 11/022 62/441

(Continued)

FOREIGN PATENT DOCUMENTS

CN 107588587 1/2018
JP 5-8366 2/1993

(Continued)

OTHER PUBLICATIONS

Jung et al. "Refrigerator", Apr. 7, 2003; Espacenet, KR 20030027367, description, all (Year: 2003).*

(Continued)

*Primary Examiner* — Filip Zec
(74) *Attorney, Agent, or Firm* — Staas & Halsey LLP

(57) ABSTRACT

A refrigerator includes a cabinet having a first storage compartment and a second storage compartment, and a cooling module removably mounted to the cabinet. The cooling module includes an evaporator, a condenser, and a compressor. A first cold air duct extends from the first storage compartment and is configured to allow a portion of the cooling module in which the evaporator is arranged, to communicate with the first storage compartment when the cooling module is coupled to the cabinet, and a second cold air duct is different from the first cold air duct and extends from the second storage compartment. The second cold air duct is configured to allow the portion of the cooling module in which the evaporator is arranged, to communicate with the second storage compartment.

19 Claims, 21 Drawing Sheets

(56) References Cited

U.S. PATENT DOCUMENTS

| | | | | |
|---|---|---|---|---|
| 7,703,293 | B2 * | 4/2010 | An | F25D 17/065 62/186 |
| 7,950,248 | B2 * | 5/2011 | Cho | F25D 23/003 62/446 |
| 2004/0261444 | A1 * | 12/2004 | Chastine | F25D 17/065 62/408 |
| 2006/0130518 | A1 * | 6/2006 | Kang | F25B 39/02 62/525 |
| 2008/0314054 | A1 | 12/2008 | An et al. | |
| 2016/0153694 | A1 * | 6/2016 | Ko | F25D 17/04 62/186 |
| 2016/0298891 | A1 | 10/2016 | Grewal et al. | |

FOREIGN PATENT DOCUMENTS

| | | | |
|---|---|---|---|
| JP | 7-294097 | | 11/1995 |
| JP | 8-247618 | | 9/1996 |
| JP | 3099634 | B2 | 8/2000 |
| JP | 2018-48798 | | 3/2018 |
| KR | 1998-014956 | U | 6/1998 |
| KR | 2003-0027367 | | 4/2003 |
| KR | 10-2009-0113577 | | 11/2009 |
| KR | 10-2017-0028358 | | 3/2017 |
| KR | 10-1821289 | | 1/2018 |
| WO | 2010/043009 | A2 | 4/2010 |
| WO | 2010/043009 | A3 | 4/2010 |

OTHER PUBLICATIONS

International Search Report dated Mar. 20, 2020 from International Patent Application No. PCT/KR2019/015973, 3 pages.

Extended European Search Report dated Oct. 22, 2021 from European Application No. 19899444.4.

Chinese Office Action dated Aug. 10, 2022 for Chinese Application No. 201980085805.1.

* cited by examiner

REFRIGERATOR

CROSS-REFERENCE TO RELATED APPLICATION(S)

This application is based on and claims priority under 35 U.S.C. § 119 to Korean Patent Application No. 10-2018-0165556, filed on Dec. 19, 2018, in the Korean Intellectual Property Office, the disclosure of which is incorporated by reference herein in its entirety

BACKGROUND

1. Field

The disclosure relates to a refrigerator, and more particularly, to a refrigerator including a cold air supply system having an improved structure.

2. Description of Related Art

A refrigerator is an apparatus configured to keep foods fresh by including a main body having a storage compartment, and a cold air supply system configured to supply cold air to the storage compartment. The storage compartment includes a refrigerating compartment maintained at about 0 to 5° C. for storing foods in a refrigerating state and a freezing compartment maintained at about −30 to 0° C. for storing foods in a freezing state.

In the refrigerator, an insulating material is provided in a cabinet forming the storage compartment, and a machine room is formed outside the cabinet. Among components constituting the cold air supply system, a compressor and an condenser are arranged in the machine room formed outside the cabinet, an evaporator is arranged in the storage compartment formed inside the cabinet, and a refrigerant pipe through which the refrigerant moves is arranged to penetrate the insulating material.

Accordingly, when testing the cooling performance of the cold air supply system of the refrigerator, it is required that all the components of the cold air supply system are installed in the cabinet. Further, when maintaining and repairing the cold air supply system, it is required to disassemble the cabinet.

SUMMARY

Therefore, it is an aspect of the disclosure to provide a refrigerator capable of easily maintaining and repairing a cold air supply system.

It is another aspect of the disclosure to provide a refrigerator capable of cooling a plurality of storage compartments by using a relatively simple configuration.

It is another aspect of the disclosure to provide a refrigerator capable of improving productivity by improving the manufacturing process.

Additional aspects of the disclosure will be set forth in part in the description which follows and, in part, will be obvious from the description, or may be learned by practice of the disclosure.

In accordance with an aspect of the disclosure, a refrigerator includes a cabinet having a first storage compartment and a second storage compartment, and a cooling module removably coupled to the cabinet and including an evaporator, a condenser, and a compressor. The cabinet includes a first cold air duct extending from the first storage compartment and configured to allow a portion of the cooling module, in which the evaporator is arranged, to communicate with the first storage compartment when the cooling module is coupled to the cabinet, and a second cold air duct, different from the first cold air duct and extending from the second storage compartment, and configured to allow the portion of the cooling module, in which the evaporator is arranged, to communicate with the second storage compartment.

The cooling module may include a module body, to which the evaporator is mounted, and having a module insulating material.

The cooling module may include a base plate arranged below the module body, and the compressor and the condenser may be mounted to the base plate.

A first circulation duct may be arranged to penetrate the cabinet, a guide duct may be arranged to penetrate the module body, and the first circulation duct and the guide duct may allow the first storage compartment to communicate with the portion of the cooling module in which the evaporator is arranged.

The cooling module may include a fan configured to move cold air, which is generated in the evaporator, to at least one of the first cold air duct and the second cold air duct when the cooling module is coupled to the cabinet.

The evaporator may include a first evaporator configured to supply cold air to the first cold air duct, and a second evaporator configured to supply cold air to the second cold air duct, and the fan may include a first fan configured to move cold air, which is generated in the first evaporator, to the first cold air duct, and a second fan configured to move cold air, which is generated by the second evaporator, to the second cold air duct.

A third storage compartment may be provided inside the cabinet, and a connection duct may be configured to form at least one portion of a flow path through which cold air, which is generated by the second evaporator, flows to the third storage compartment.

The refrigerator may further include a connection duct damper arranged in the connection duct.

The connection duct may be arranged to penetrate the module body.

The first fan may be arranged in the rear of the third storage compartment; and the second fan may be arranged in the rear of the second storage compartment.

The refrigerator may further include a second circulation duct configured to guide air from the third storage compartment to the second storage compartment.

The refrigerator may further include an ice making compartment provided inside the cabinet, and an ice making compartment cold air duct configured to guide cold air, which is generated in the second evaporator, to the ice making compartment.

The refrigerator may further include an ice making compartment damper arranged in the ice making compartment cold air duct.

The first cold air duct may be arranged to penetrate the cabinet.

The refrigerator may further include a duct cover arranged on a rear wall of the first storage compartment and configured to distribute cold air, which is supplied through the first cold air duct, to the first storage compartment.

In accordance with another aspect of the disclosure, a refrigerator includes a cabinet having a first storage compartment, a second storage compartment, and a third storage compartment and having a cooling module mounting portion accessible from outside the cabinet, a cooling module removably coupled to the cooling module mounting portion and having a first evaporator and a second evaporator. The cabinet includes a first cold air duct extending from the first storage compartment and arranged to guide cold air, which is generated in the first evaporator, to the first storage compartment when the cooling module is coupled to the cooling module mounting portion of the cabinet, a second cold air duct extending to the second storage compartment and different from the first cold air duct, arranged to guide cold air, which is generated in the second evaporator, to the second storage compartment when the cooling module is coupled to the cooling module mounting portion of the cabinet, and a connection duct different from the first and second cold air ducts arranged in the module body to form at least one portion of a flow path guiding the cold air, which is generated in the second evaporator, to the third storage compartment when the cooling module is coupled to the cooling module mounting portion of the cabinet.

The cooling module may include a module body to which the first evaporator and the second evaporator are mounted and having a module insulating material arranged therein.

The connection duct may be arranged to penetrate the module body.

The cooling module may include a first fan configured to move cold air, which is generated in the first evaporator, to the first cold air duct, and a second fan configured to move cold air, which is generated in the second evaporator, to the second cold air duct and the connection duct.

In accordance with another aspect of the disclosure, a refrigerator includes a cabinet having a first storage compartment, a second storage compartment and a third storage compartment, a cooling module including a first evaporator configured to generate cold air to be supplied to the first storage compartment and a second evaporator configured to generate cold air to be supplied to the second storage compartment and the third storage compartment, a cold air duct configured to allow a portion of the cooling module, in which the first evaporator is arranged, to communicate with the first storage compartment, and a connection duct arranged to form at least one portion of a flow path connecting a portion, in which the second evaporator is arranged, to the third storage compartment.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
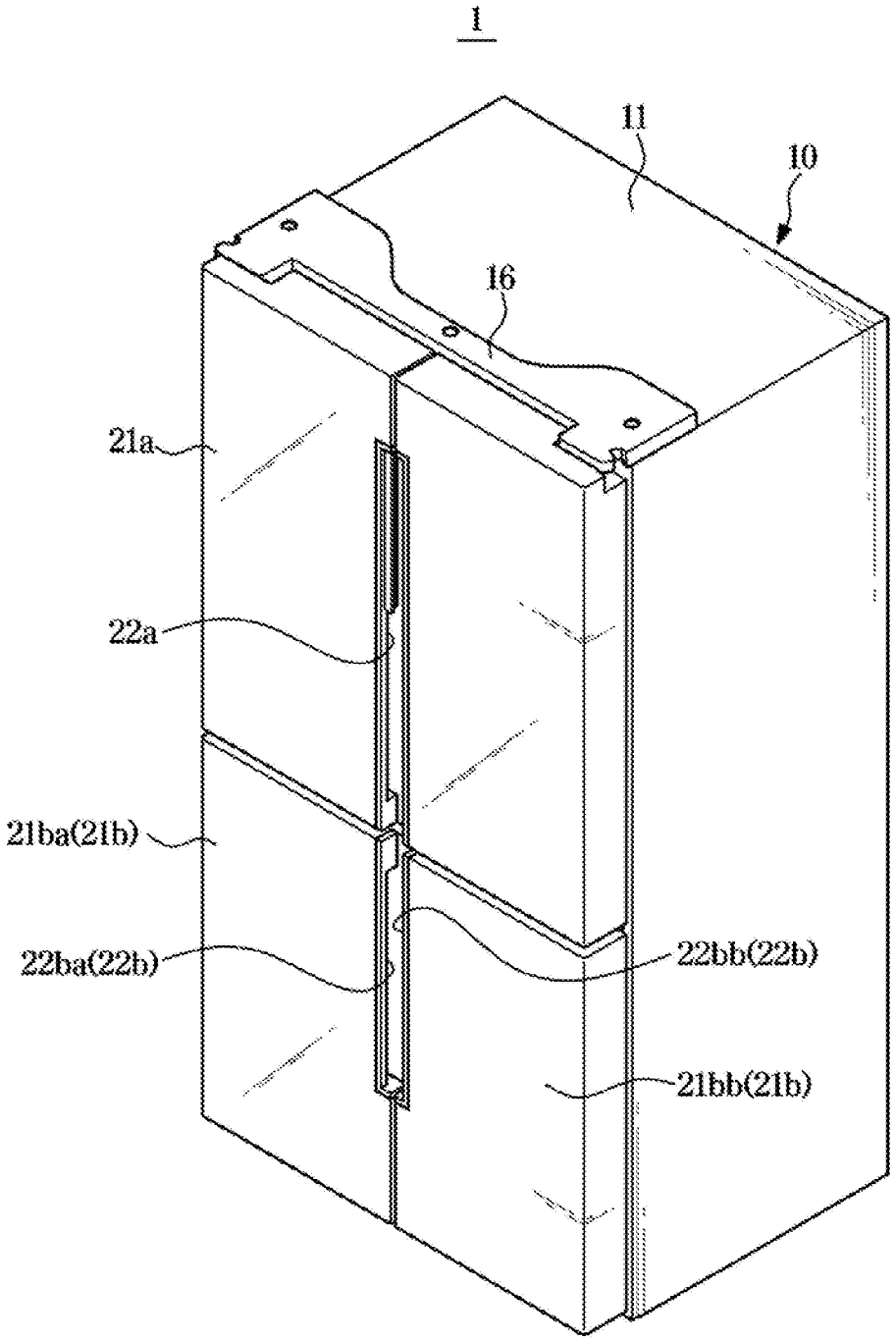
FIG. 1 is a view of a refrigerator according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise.

In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "front", "rear", "upper portion", "lower portion", and the like may be defined by the drawings, but the shape and the location of the component is not limited by the term.

The disclosure will be described more fully hereinafter with reference to the accompanying drawings.

Figure 2:
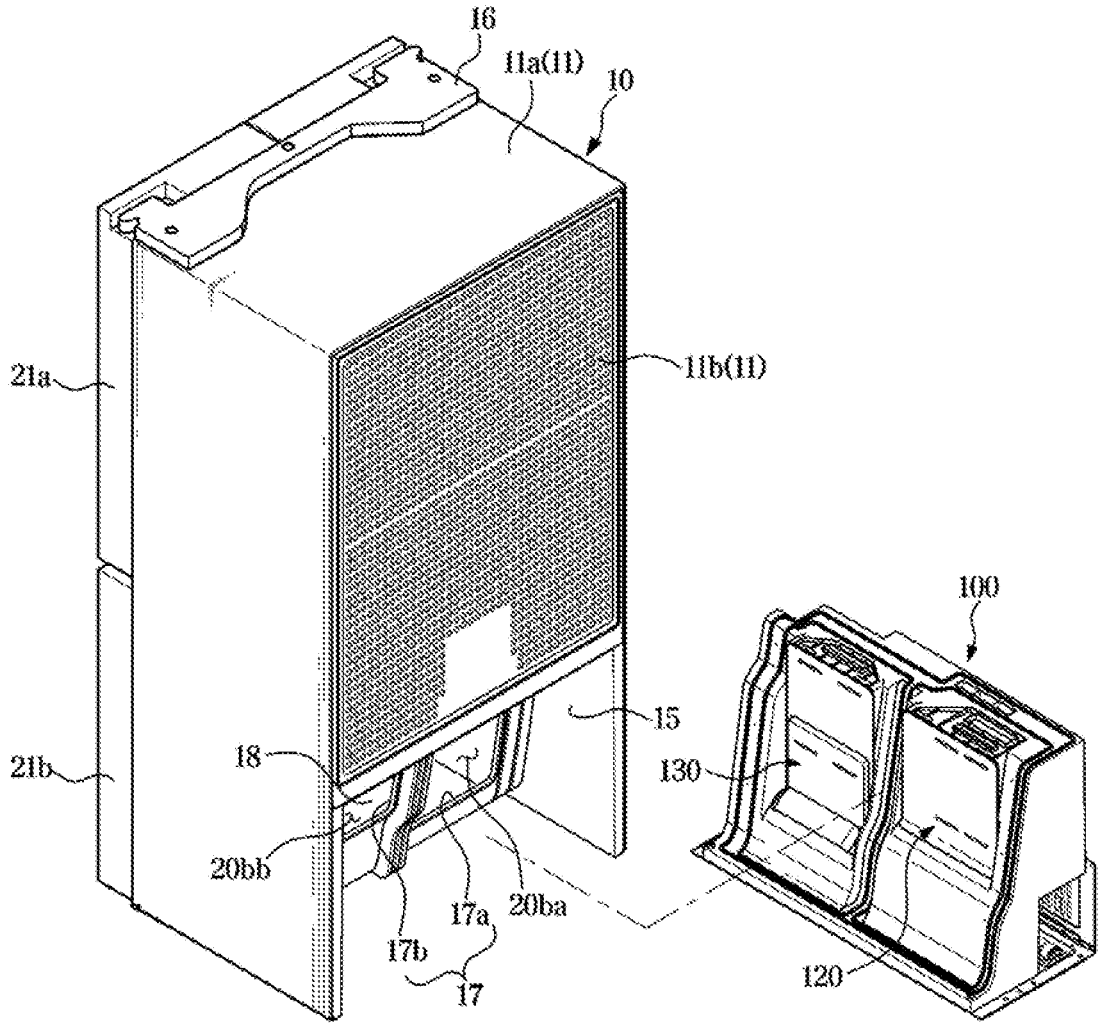
FIG. 2 is a view illustrating a state in which a cooling module is separated from a cabinet of the refrigerator shown in FIG. 1.
Figure 3:
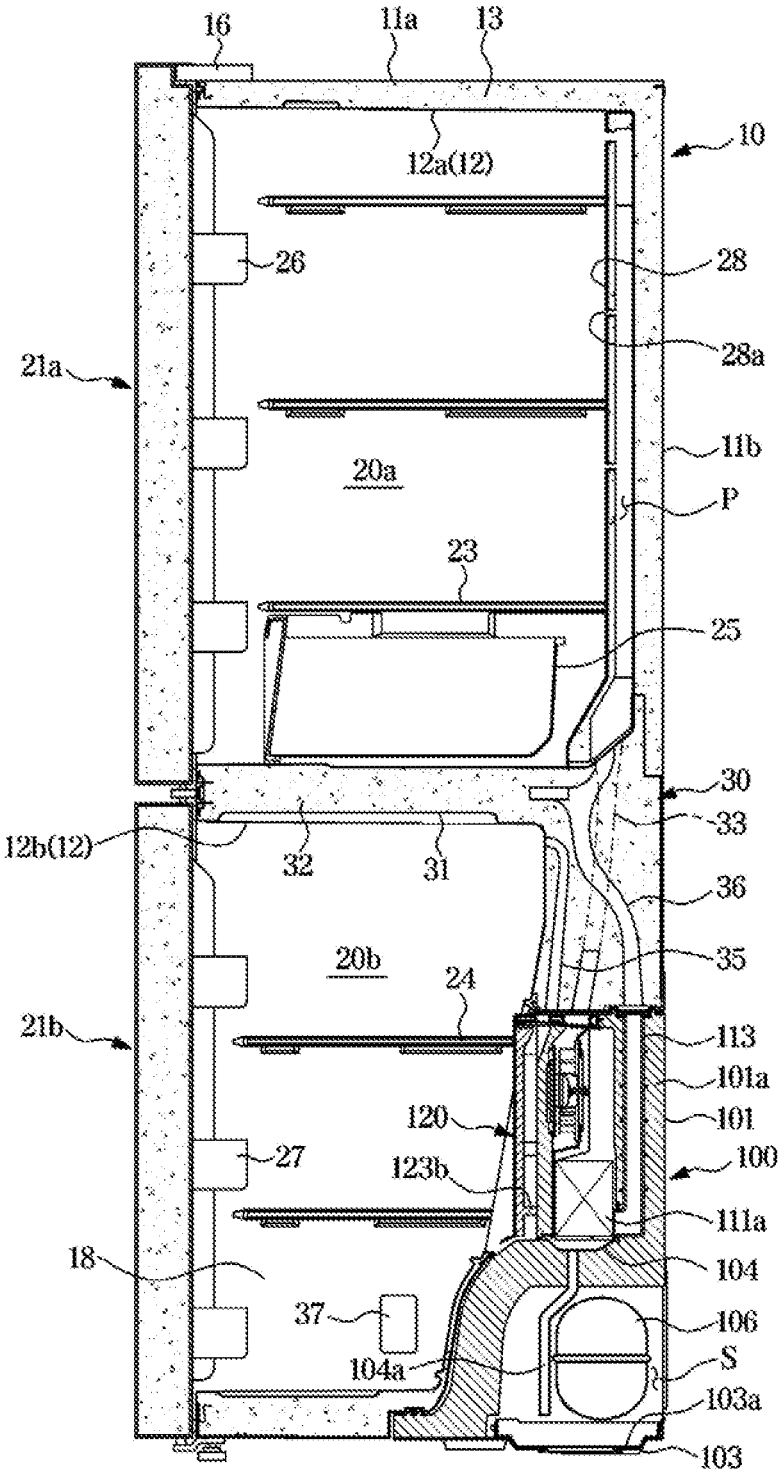
FIG. 3 is a cross-sectional view of the refrigerator shown in FIG. 1.

FIG. 1 is a view of a refrigerator according to an embodiment of the disclosure. FIG. 2 is a view illustrating a state in which a cooling module is separated from a cabinet of the refrigerator shown in FIG. 1. FIG. 3 is a cross-sectional view of the refrigerator shown in FIG. 1.

Referring to FIGS. 1 to 3, a refrigerator 1 may include a cabinet 10 forming storage compartments 20*a* and 20*b*, doors 21*a* and 21*b* configured to open and close the storage compartments 20*a* and 20*b*, and a cooling module 100 removably coupled to the cabinet 10 and configured to supply cold air to the storage compartments 20*a* and 20*b*.

The cabinet 10 may include an outer case 11 and an inner case 12 coupled to the inside of the outer case 11. The outer case 11 may include a cabinet body 11*a* in which front and rear surfaces are opened, and a cabinet cover 11*b* covering a rear surface of the cabinet body 11*a*. The front surface of the cabinet body 11*a* may be covered by the doors 21*a* and 21*b*. The outer case 11 may be formed of a metal material.

The inner case 12 may form the storage compartments 20*a* and 20*b*. The inner case 12 may be formed by injecting a plastic material. The inner case 12 may include a first inner case 12*a* forming an upper storage compartment 20*a* and a second inner case 12*b* forming a lower storage compartment 20*b*.

A cabinet insulating material 13 may be provided between the outer case 11 and the inner case 12. The cabinet insulating material 13 may be formed of urethane foam insulation or alternatively, the cabinet insulating material 13 may be formed of a vacuum insulation panel together with urethane foam insulation, as needed.

The cabinet 10 may include an intermediate body 30 arranged between the first inner case 12*a* and the second inner case 12*b*. The intermediate body 30 may include a partition 31 configured to divide the storage compartments 20*a* and 20*b* into the upper compartment 20*a* and the lower compartment 20*b*. The intermediate body 30 may include an intermediate insulating material 32 to prevent heat exchange between the upper storage compartment 20*a* and the lower storage compartment 20*b*. The intermediate insulating material 32 may be provided to prevent the loss of cold air to the outside at a portion of the rear of the lower storage compartment 20*b*.

In the intermediate body 30, a first cold air duct 33, a second cold air duct 34 (see FIG. 7), a third cold air duct 35, and a first circulation duct 36 may be arranged. The first cold air duct 33, the second cold air duct 34, the third cold air duct 35, and the first circulation duct 36 may be arranged to penetrate the intermediate insulating material 32. Details of the first cold air duct 33, the second cold air duct 34, the third cold air duct 35, and the first circulation duct 36 will be described later.

The storage compartments 20*a* and 20*b* may be formed in such a way that the front surface of the storage compartments 20*a* and 20*b* opens to allow foods to be inserted into or taken out therefrom. The storage compartments 20*a* and 20*b* may include the upper storage compartment 20*a* and the lower storage compartment 20*b*. The upper storage compartment 20*a* may be maintained at approximately 0 to 5° C. and may be used as a refrigerating compartment for storing food at a refrigerating state. The upper storage compartment 20*a* may be referred to as the first storage compartment 20*a*.

Referring to FIG. 3, in the first storage compartment 20*a*, a guide cover 28 configured to distribute cold air supplied from the first cold air duct 33 may be arranged. Together with the first inner case 12*a*, the guide cover 28 may form a flow path P, through which cold air received from the first cold air duct 33 flows.

The guide cover 28 may include one or more guide holes 28*a* supplying the cold air received from the first cold air duct 3 to the first storage compartment 20*a*. The guide holes 28*a* may be provided in plural in the vertical direction.

The lower storage compartment 20*b* may include a second storage compartment 20*ba* and a third storage compartment 20*bb*. The cabinet 10 may include a separation plate 18 configured to separate the second storage compartment 20*ba* from the third storage compartment 20*bb*. The second storage compartment 20*ba* may be maintained at about −30 to 0° C. and may be used as a freezing compartment for storing food at a freezing state. The third storage compartment 20*bb* may be used as a temperature variable compartment configured to vary the temperature. However, the use of the first storage compartment 20*a*, the second storage compartment 20*ba*, and the third storage compartment 20*bb* may be changed.

Open front surfaces of the storage compartments 20*a* and 20*b* may be opened and closed by the doors 21*a* and 21*b*. The storage compartments 20*a* and 20*b* may be provided with shelves 23 and 24 on which food is placed, and storage containers 25 storing food.

The upper door 21*a* may be configured to open and close the first storage compartment 20*a*. The upper door 21*a* may be coupled to the cabinet 10 to be rotatable in the left and right directions. An upper door guard 26 storing food may be provided on the rear surface of the upper door 21*a*. A hinge cover 16 may be provided at a portion of the cabinet 10 to which the upper door 21*a* is coupled. The upper door 21*a* may be referred to as a first door 21*a*.

The first door 21*a* may include a first door handle 22*a*. A user may open and close the first door 21*a* by holding the first door handle 22*a*.

The lower door 21*b* may be configured to open and close the lower storage compartment 20*b*. The lower door 21*b* may be coupled to the cabinet 10 to be rotatable in the left and right directions. A lower door guard 27 storing food may be provided on the rear surface of the lower door 22. The lower door 21*b* may include a second door 21*ba* opening and closing the second storage compartment 20*ba* and a third door 21*bb* opening and closing the third storage compartment 20*bb*.

The lower door 21*b* may include a lower door handle 22*b*. A user can open and close the lower door 21*b* by holding the lower door handle 22*b*. Particularly, the second door 21*ba* may include a second door handle 22*ba*, and the third door 21*bb* may include a third door handle 22*bb*.

In a lower portion of the cabinet 10, a cooling module mounting portion 15, in which the cooling module 100 is removably mounted, may be provided. The cooling module mounting portion 15 may be provided in a size and shape corresponding to the cooling module 100.

The cabinet 10 may include a storage compartment opening 17. The storage compartment opening 17 may be formed in the cooling module mounting portion 15. The storage compartment opening 17 may include a first storage compartment opening 17*a* configured to allow the cooling module mounting portion 15 to communicate with the second storage compartment 20*ba*, and a second storage compartment opening 17*b* configured to allow the cooling module mounting portion 15 to communicate with the third storage compartment 20*bb*.

Figure 4:
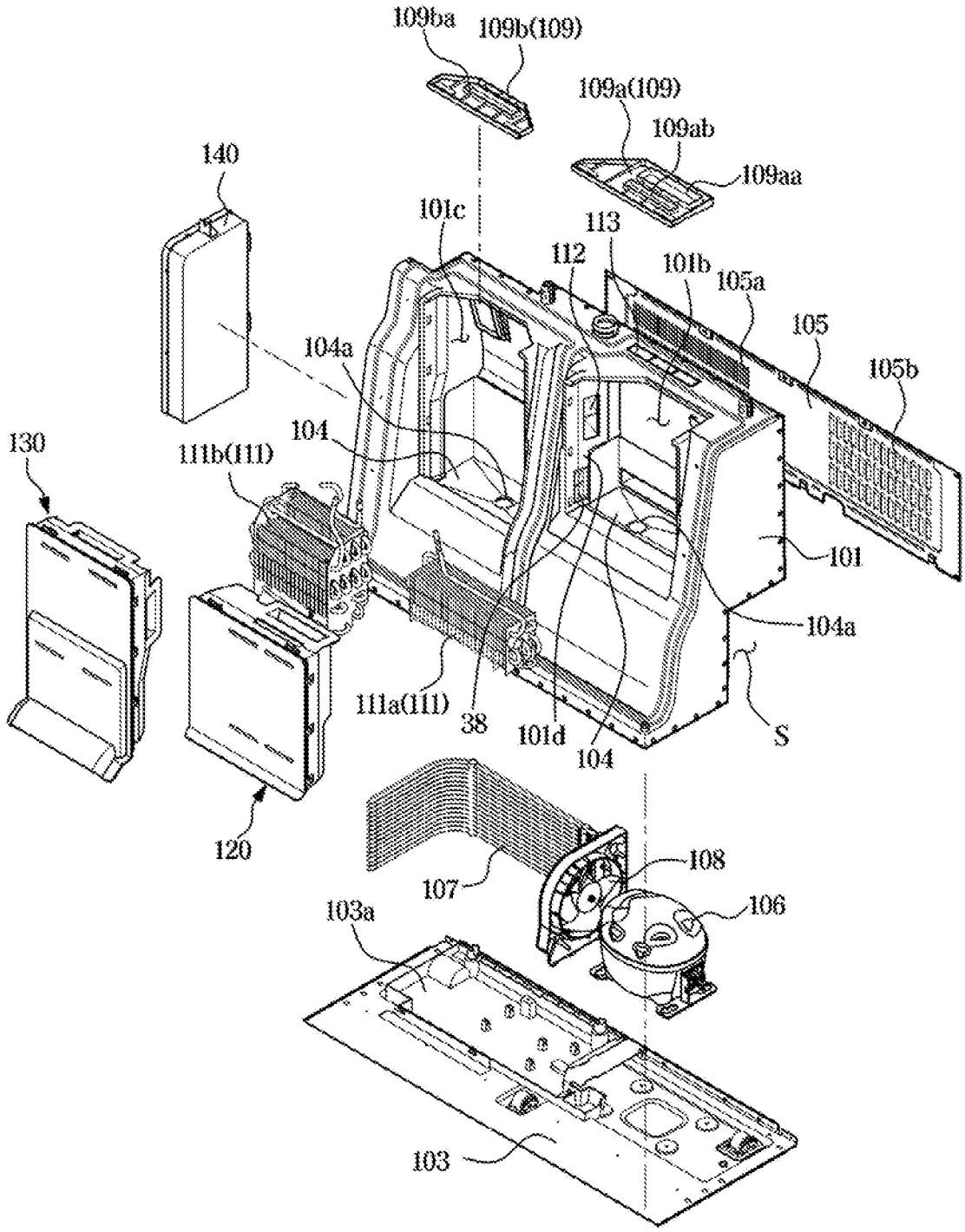
FIG. 4 is an exploded view of the cooling module shown in FIG. 2.
Figure 5:
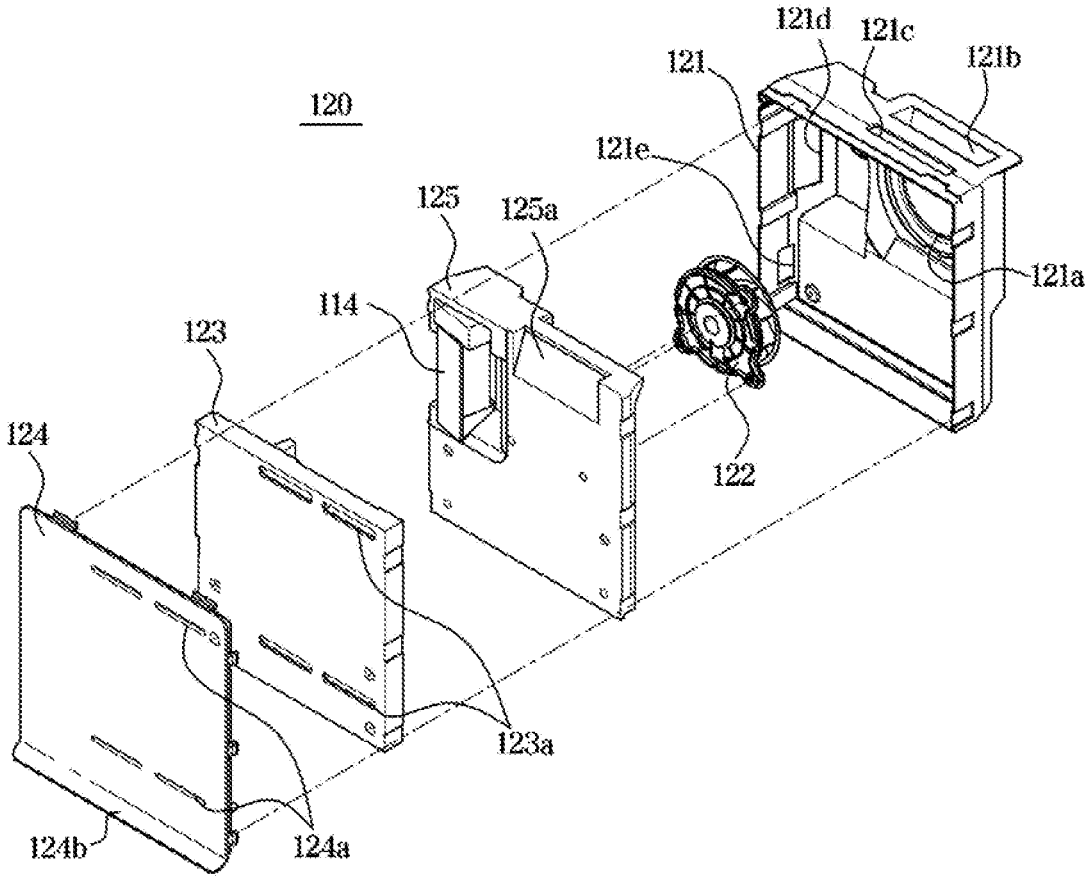
FIG. 5 is an exploded view of a first duct module shown in FIG. 4.
Figure 6:
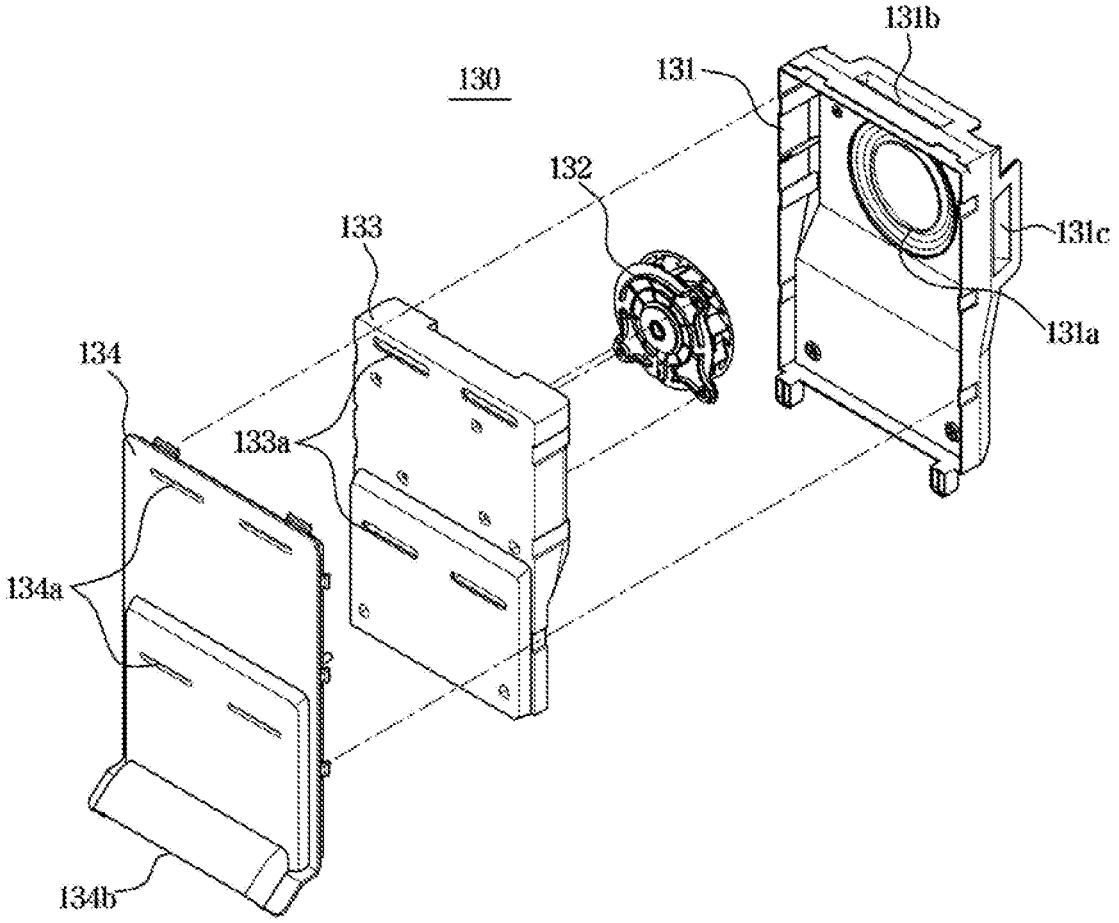
FIG. 6 is an exploded view of a second duct module shown in FIG. 4.

FIG. 4 is an exploded view of the cooling module 100 shown in FIG. 2. FIG. 5 is an exploded view of a first duct module shown in FIG. 4. FIG. 6 is an exploded view of a second duct module shown in FIG. 4.

The cooling module 100 may generate cold air by using latent heat of vaporization of the refrigerant through the cooling cycle. The cooling module 100 may be configured to generate cold air to be supplied to the first storage compartment 20*a*, the second storage compartment 20*ba*, and the third storage compartment 20*bb*. The cooling module 100 may be removably mounted to the cabinet 10.

Referring to FIG. 4, the cooling module 100 may include a module body 101, a base plate 103, a compressor 106, a condenser 107, an evaporator 111, and an expansion valve (not shown).

The module body 101 may form a part of the rear surface of the refrigerator 1. The module body 101 may include a module insulating material 101*a* provided to prevent loss of cold air generated from the evaporator 111.

The module body 101 may include receiving portions 101*b* and 101*c* in which the evaporator 111 is arranged. Particularly, the receiving portions 101*b* and 101*c* may include a first receiving portion 101*b* in which a first evaporator 111*a* is arranged and a second receiving portion 101*c* in which a second evaporator 111*b* is arranged.

The module body 101 may include a partition wall 101*d* arranged between the first receiving portion 101*b* and the second receiving portion 101*c*. The partition wall 101*d* may be arranged to correspond to a boundary between the second storage compartment 20*ba* and the third storage compartment 20*bb*. The module insulating material 101*a* may also be arranged in the partition wall 101*d*.

A connection duct 112 may be provided at the partition wall 101*d* to penetrate the module insulating material 101*a*. The connection duct 112 may be formed to allow cold air, which is to be supplied to the third storage compartment 20*bb*, to move therethrough. The connection duct 112 may be provided to allow the first receiving portion 101*b* to communicate with the second receiving portion 101*c*. One end of the connection duct 112 may be connected to a first fan connection port 121*d*, and the other end thereof may be connected to a second fan connection port 131*c*.

A third circulation duct 38 may be provided at the partition wall 101*d* to penetrate the module insulating material 101*a*. The third circulation duct 38 may be configured to allow air, which has cooled the third storage compartment 20*bb*, to flow to the second evaporator 111*b*. The third circulation duct 38 may allow the first receiving portion 101*b* to communicate with the second receiving portion 101*c*. The third circulation duct 38 may be configured to allow a part of a space, which is between a separation cover 125 and a first fan cover 123, to communicate with a space in which the second evaporator 111*b* is arranged.

A guide duct 113 may be provided in the module body 101. The guide duct 113 may be arranged to penetrate the module insulating material 101*a* of the module body 101. The guide duct 113 may be connected to the first circulation duct 36. The guide duct 113 may allow the first circulation duct 36 to communicate with the first receiving portion 101*b* in which the first evaporator 111*a* is arranged.

The base plate 103 may be arranged below the module body 101. The base plate 103 may cover the lower portion of the module body 101. The compressor 106 may be fixed to the base plate 103. The condenser 107 may be fixed to the base plate 103. A cooling fan 108 may be fixed to the base plate 103.

A water collection pan 103*a* may be arranged on the base plate 103. The water collection pan 103*a* may collect condensed water generated by the condenser 107 and/or the evaporator 111. The condenser 107 may be arranged above the water collection pan 103*a*.

The module body 101 may include a drain pan 104 and a drain pipe 104*a* for guiding condensed water generated in the evaporator 111 to the water collection pan 103*a*.

The drain pan 104 may be arranged below the evaporator 111. The drain pan 104 may be arranged below the first evaporator 111*a* and the second evaporator 111*b*, respectively. The drain pan 104 may be arranged in the first receiving portion 101*b* and the second receiving portion 101*c*, respectively.

The drain pipe 104*a* may be configured to guide the condensed water collected in the drain pan 104 to the water collection pan 103*a*. At least a portion of the drain pipe 104*a* may be arranged to penetrate the module insulating material 101*a*.

An electrical box 140 may be arranged on the base plate 103. The electrical box 140 may be arranged at one side where the second receiving portion 101*c* is arranged. The electrical box 140 may control the cooling module 100 to change the temperatures of the storage compartments 20*a* and 20*b*. The electrical box 140 may be configured to receive power for driving the refrigerator 1.

A module cover 105 may cover the rear lower side of the module body 101.

Together with the base plate 103, the module cover 105 may cover a machine room S, which is provided in the lower part of the module body 101 and receives the compressor 106, the condenser 107, and the cooling fan 108. The module cover 105 may include a cover inlet 105*a* through which the outside air is introduced by the cooling fan 108, and a cover outlet 105*b* through which the introduced air is discharged to the outside.

The compressor 106 may compress the refrigerant and move the compressed refrigerant to the condenser 107. The condenser 107 may condense the refrigerant and move the condensed refrigerant to the expansion valve. The cooling fan 108 may cool the compressor 106 and the condenser 107. As the cooling fan 108 is driven, air may flow into the machine room S through the cover inlet 105*a* and heat of the air may be exchanged with the condenser 107 and the compressor 106, and then the air may be discharged to the outside of the machine room S through the cover outlet 105*b*.

The evaporator 111 may be configured to generate cold air. The evaporator 111 may be arranged in the receiving portions 101*b* and 101*c*. The evaporator 111 may include the first evaporator 111*a* and the second evaporator 111*b*. The first evaporator 111*a* may be arranged in the first receiving portion 101*b*. The second evaporator 111*b* may be arranged in the second receiving portion 101*c*.

The cooling module 100 may include a cap 109 covering the open upper portions of the receiving portions 101*b* and 101*c*. The cap 109 may include a first cap 109*a* covering an upper portion of the first receiving portion 101*b* and a second cap 109*b* covering an upper portion of the second receiving portion 101*c*.

The first cap 109*a* may be arranged above the first duct module 120. The first cap 109*a* may include a first a (la) cap hole 109*aa* provided to correspond to a first a (la) fan outlet 121*b* formed in a first fan case 121, and a first b (1*b*) cap hole 109*ab* provided to correspond to a first b (1*b*) fan outlet 121*c* formed in the first fan case 121. The first a (la) cap hole 109*aa* may communicate with the first cold air duct 33. The first b (1*b*) cap hole 109*ab* may communicate with the third cold air duct 35.

The second cap 109*b* may be arranged above the second duct module 130. The second cap 109*b* may include a second cap hole 109*ba* provided to correspond to a second fan outlet 131*b* formed in a second fan case 131. The second cap hole 109*ba* may communicate with the second cold air duct 34.

The duct modules 120 and 130 configured to move the cold air generated by the evaporator 111 to the storage compartments 20*a* and 20*b* may be arranged in the receiving portions 101*b* and 101*c*. The duct modules 120 and 130 may include the first duct module 120 arranged in the first receiving portion 101*b* and the second duct module 130 arranged in the second receiving portion 101*c*.

Particularly, referring to FIGS. 5 and 6, the first duct module 120 may include the first fan case 121, the first fan 122, the first fan cover 123, and a first duct cover 124, and the separation cover 125.

The first fan case 121 may be arranged to cover the first fan 122. The first fan case 121 may be removably coupled to the first receiving portion 101*b*. The first fan case 121 may be fixed to the module body 101.

The first fan case 121 may include a first fan inlet 121*a* through which air, which is heat-exchanged with the first evaporator 111*a*, is introduced. The first fan inlet 121*a* may be formed on the rear surface of the first fan case 121.

The first fan case 121 may include the first a (la) fan outlet 121*b* communicating with the first cold air duct 33. The first a (la) fan outlet 121*b* may discharge cold air to supplied to the first storage compartment 20*a*. The first a (la) fan outlet 121*b* may be formed on the upper surface of the first fan case 121.

The first fan case 121 may include the first b (1*b*) fan outlet 121*c* communicating with the third cold air duct 35. The first b (1*b*) fan outlet 121*c* may discharge cold air to be supplied to the third storage compartment 20*bb*. The first b (1*b*) fan outlet 121*c* may be formed on the upper surface of the first fan case 121.

The first fan case 121 may include a first fan connection port 121*d* communicating with the connection duct 112. The first fan connection port 121*d* may be configured to allow air blown by a second fan 132 to be introduced. The first fan connection port 121*d* may be provided to allow cold air, which is to be supplied to the third storage compartment 20*bb*, to be introduced. The first fan connection port 121*d* may be formed on the side surface of the first fan case 121.

The first fan case 121 may include a first fan circulation port 121*e* communicating with the third circulation duct 38. The first fan circulation port 121*e* may be provided to guide the air, which has cooled the third storage compartment 20*bb*, to the second evaporator 111*b*. The first fan circulation port 121*e* may discharge air, which is introduced into the first duct module 120 through the first duct circulation port 127, to the second receiving portion 101*c* in which the second evaporator 111*b* is arranged. The first fan circulation port 121*e* may be formed at a side facing the partition wall 101*d* of the first fan case 121.

The first fan 122 may be driven to supply air, which is heat-exchanged with the first evaporator 111*a*, to the first storage compartment 20*a*. The first fan 122 may be arranged in the first receiving portion 101*b*. The first fan 122 may be fixed to the separation cover 125.

The first fan cover 123 may be coupled to the front of the first fan case 121. The separation cover 125 may be arranged between the first fan cover 123 and the first fan case 121. A separation rib 123*b* may be provided on the rear surface of the first fan cover 123 to divide a space between the separation cover 125 and the first fan cover 123. By the separation rib 123*b*, the space between the first fan cover 123 and the separation cover 125 may be divided into a space where air is supplied from the connection duct 112 and a space where air, which has cooled the third storage compartment 20*bb*, is collected.

The separation cover 125 may cover the front of the first fan case 121. The separation cover 125 may divide a space formed by the first fan case 121 and the first fan cover 123. Together with the first fan case 121, the separation cover 125 may form a space, in which cold air, which is to be supplied to the first storage case 20*a*, flows. Together with the first fan cover 123, the separation cover 125 may form a space, in which cold air, which is to be supplied to the third storage compartment 20*bb*, flows. At the rear of the separation cover 125, a flow path on which air, which is heat-exchanged with the first evaporator 111*a*, flows, is formed, and at the front of the separation cover 125, a flow path on which air, which is heat-exchanged with the second evaporator 111*b*, flows is formed. At the rear of the separation cover 125, a flow path on which air, which is moved by the first fan 122, flows, may be formed, and at the front of the separation cover 125, a flow path on which air, which is moved by the second fan 132, flows, may be formed.

The separation cover 125 may prevent the air, which is heat-exchanged with the first evaporator 111*a*, from mixing with the air, which is heat-exchanged with the second evaporator 111*b*. The separation cover 125 may prevent the air, which is moved by the first fan 122, from mixing with the air, which is moved by the second fan 132. The separation cover 125 may support the first fan 122.

The separation cover 125 may include a hole forming portion 125*a* configured to form a hole communicating with the third cold air duct 35 upon being coupled to the first fan cover 123. The hole forming portion 125*a* may be formed at an upper portion of the separation cover 125.

The first fan cover 123 may be arranged in front of the separation cover 125. Together with the separation cover 125, the first fan cover 123 may form a space in which cold air, which is to be supplied to the third storage compartment 20*bb*, flows. The first fan cover 123 may be fixed to the first fan case 121.

The first fan cover 123 may include a first cover hole 123*a* communicating with the third storage compartment 20*bb*. The first cover hole 123*a* may be configured to discharge a portion of the air, which is introduced through the connection duct 112, to the third storage compartment 20*bb*. A portion of the cold air introduced through the connection duct 112 may be moved to the third cold air duct 35 and then supplied to the third storage compartment 20*bb*, and the other portion thereof may be supplied to the third storage compartment 20*bb* through the first cover hole 123*a*.

The first duct cover 124 may be arranged in front of the first fan cover 123. The first duct cover 124 may cover the front of the first fan cover 123. The first duct cover 124 may include a first duct hole 124*a* communicating with the third storage compartment 20*bb*. The first duct hole 124*a* may be provided to correspond to the first cover hole 123*a*. A portion of the cold air blown by the second fan 132 may be supplied to the third storage compartment 20*bb* through the first cover hole 123*a* and the first duct hole 124*a*.

The first duct cover 124 may include a first duct entering portion 124*b*. The first duct entering portion 124*b* may be arranged to be spaced apart from the module body 101 by a predetermined distance. Together with the module body 101, the first duct entering portion 124*b* may form the first duct circulation port 127. Air, which has cooled the third storage compartment 20*bb*, may be collected to the first duct module 120 through the first duct circulation port 127. Air, which is collected through the first duct circulation port 127, may be guided to the second evaporator 111*b* through the third circulation duct 38.

The second duct module 130 may include the second fan case 131, the second fan 132, a second fan cover 133, and a second duct cover 134.

The second fan case 131 may be arranged in the second receiving portion 101*c*.

The second fan case 131 may include a second fan inlet 131*a* through which air, which is heat-exchanged with the second evaporator 111*b*, is introduced. The second fan inlet 131*a* may be formed on the rear surface of the second fan case 131.

The second fan case 131 may include the second fan outlet 131*b* communicating with the second cold air duct 34. The second fan outlet 131*b* may discharge cold air to be supplied to the second storage compartment 20*ba*. The second fan outlet 131*b* may be formed on an upper surface of the second fan case 131.

The second fan case 131 may include the second fan connection port 131*c* communicating with the connection duct 112. The second fan connection port 131*c* may be configured to discharge air blown by the second fan 132 to the connection duct 112. The second fan connection port 131*c* may be provided to discharge cold air to be supplied to the third storage compartment 20*bb*. The second fan connection port 131*c* may be formed on the side surface of the second fan case 131.

The second fan 132 may be driven to supply air, which is heat-exchanged with the second evaporator 111*b*, to the second storage compartment 20*ba* and the third storage compartment 20*bb*. The second fan 132 may be arranged in the second receiving portion 101*c*. The second fan 132 may be fixed to the second fan cover 133.

The second fan cover 133 may be coupled to the front of the second fan case 131. The second fan cover 133 may cover the front of the second fan case 131. Together with the second fan case 131, the second fan cover 133 may form a space in which cold air, which is to be supplied to the second storage compartment 20*ba* and the third storage compartment 20*bb*, flows. The second fan cover 133 may be fixed to the second fan case 131.

The second fan cover 133 may include a second cover hole 133*a* communicating with the second storage compartment 20*ba*. The second cover hole 133*a* may be formed to discharge a portion of the air, which is blown by the second fan 132, to the second storage compartment 20*ba*. A portion of the air blown by the second fan 132 may be moved to the second cold air duct 34 and then supplied to the second storage compartment 20*ba*, and the other portion thereof may be supplied to the second storage compartment 20*bb* through the second cover hole 133*a*. The second fan cover 133 may support the second fan 132.

The second duct cover 134 may be arranged in front of the second fan cover 133. The second duct cover 134 may cover the front of the second fan cover 133.

The second duct cover 134 may include a second duct hole 134*a* communicating with the second storage compartment 20*ba*. The second duct hole 134*a* may be provided to correspond to the second cover hole 133*a*. A portion of the cold air blown by the second fan 132 may be supplied to the second storage compartment 20*ba* through the second cover hole 133*a* and the second duct hole 134*a*.

The second duct cover 134 may include a second duct entering portion 134*b*. The second duct entering portion 134*b* may be arranged to be spaced apart from the module body 101 by a predetermined distance. Together with the module body 101, the second duct entering portion 134*b* may form a second duct circulation port 137. Through the second duct circulation port 137, air, which has cooled the second storage compartment 20*ba*, may be collected to the second duct module 130. The air collected through the second duct circulation port 137 may be guided to the second evaporator 111*b*.

With this configuration, as for the refrigerator 1 according to an embodiment of the disclosure, it is possible to arrange all components of the cold air supply system of the refrigerator 1 in the cooling module 100, and it is possible to removably mount the cooling module 100 to the cabinet 10. Therefore, it is possible to test the cooling performance of the cold air supply system prior to mounting the cooling module 100 to the cabinet 10.

Further, it is possible to separate only the cooling module 100 from the cabinet when maintaining or repairing the cold air supply system, and thus it is possible to easily maintain and repair the refrigerator 1.

Figure 7:
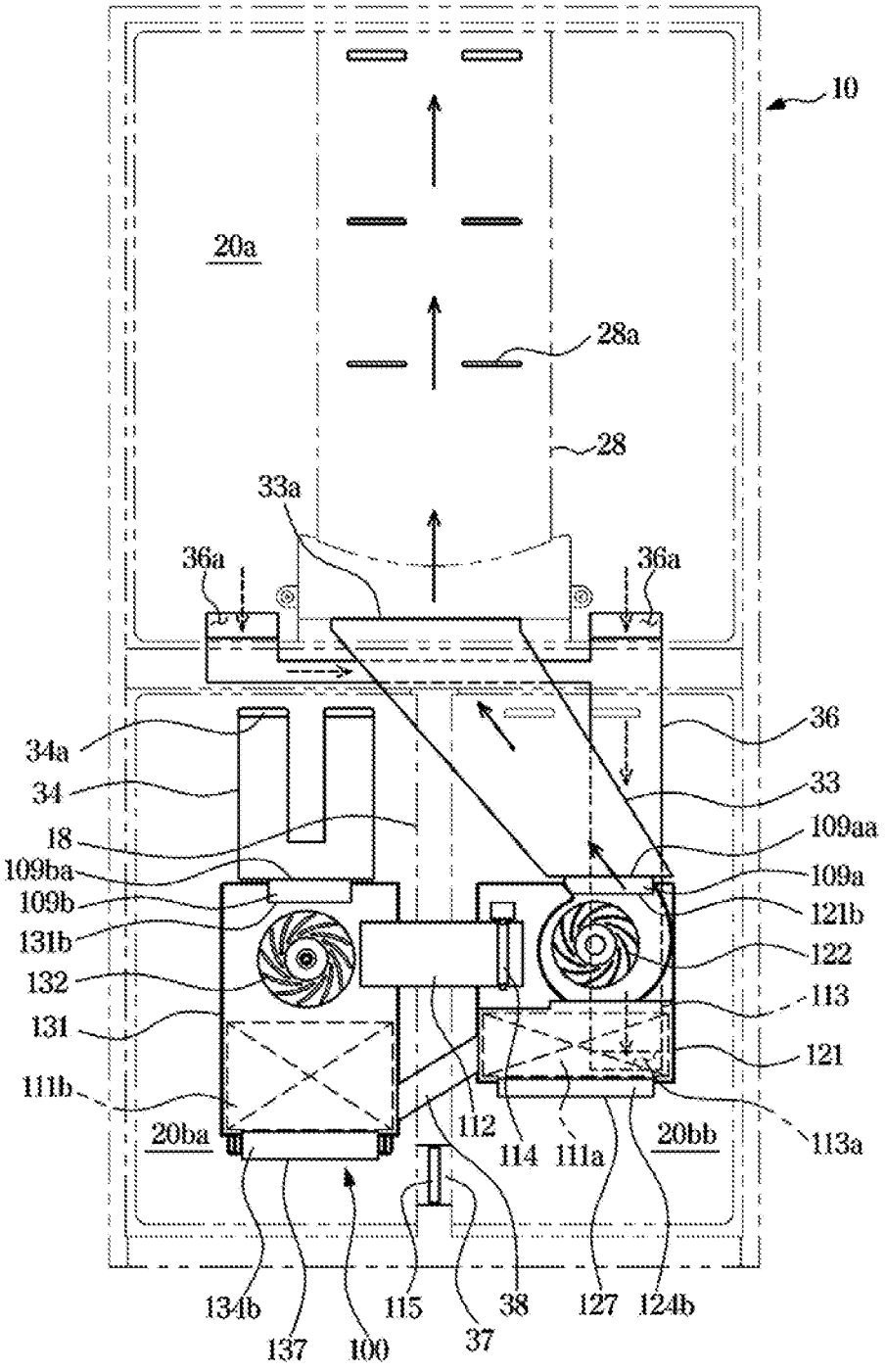
FIG. 7 is a view illustrating a flow of cold air generated by a first evaporator upon cooling a first storage compartment.
Figure 8:
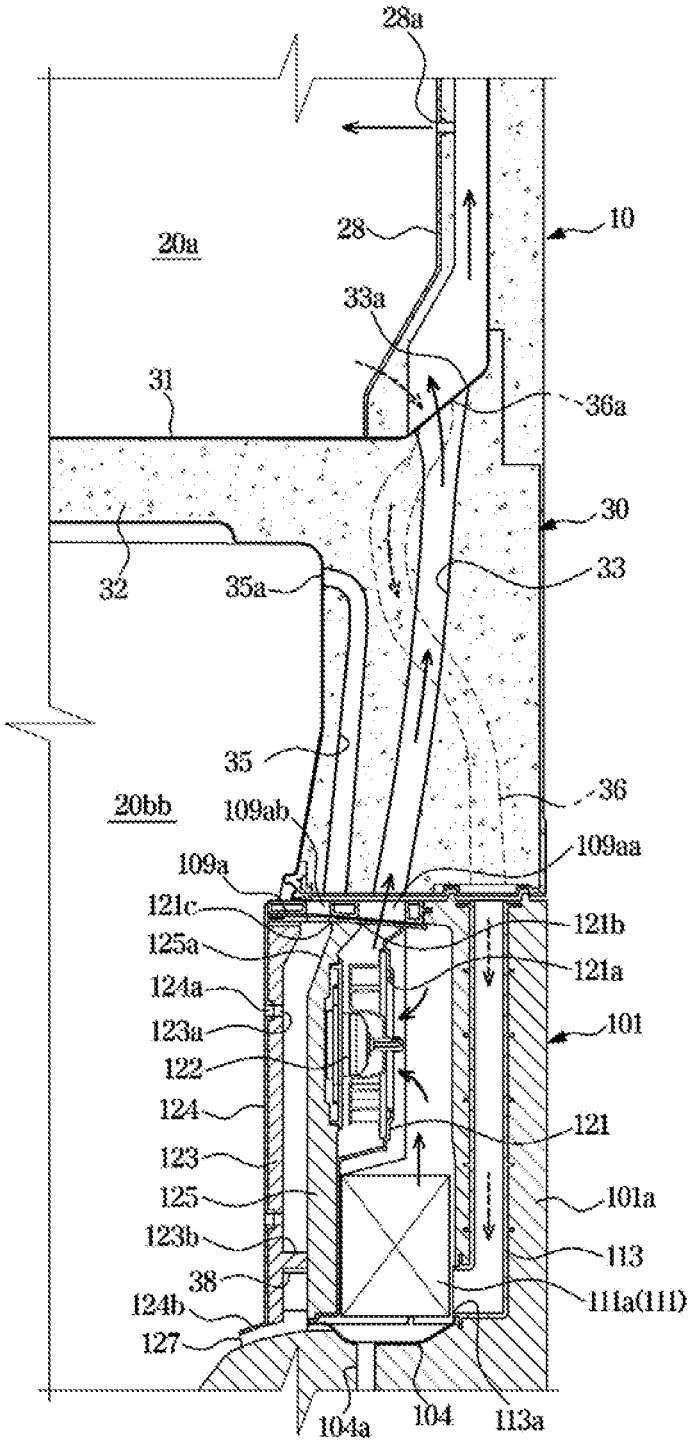
FIG. 8 is a view illustrating a flow of cold air generated by the first evaporator upon cooling the first storage compartment.
Figure 9:
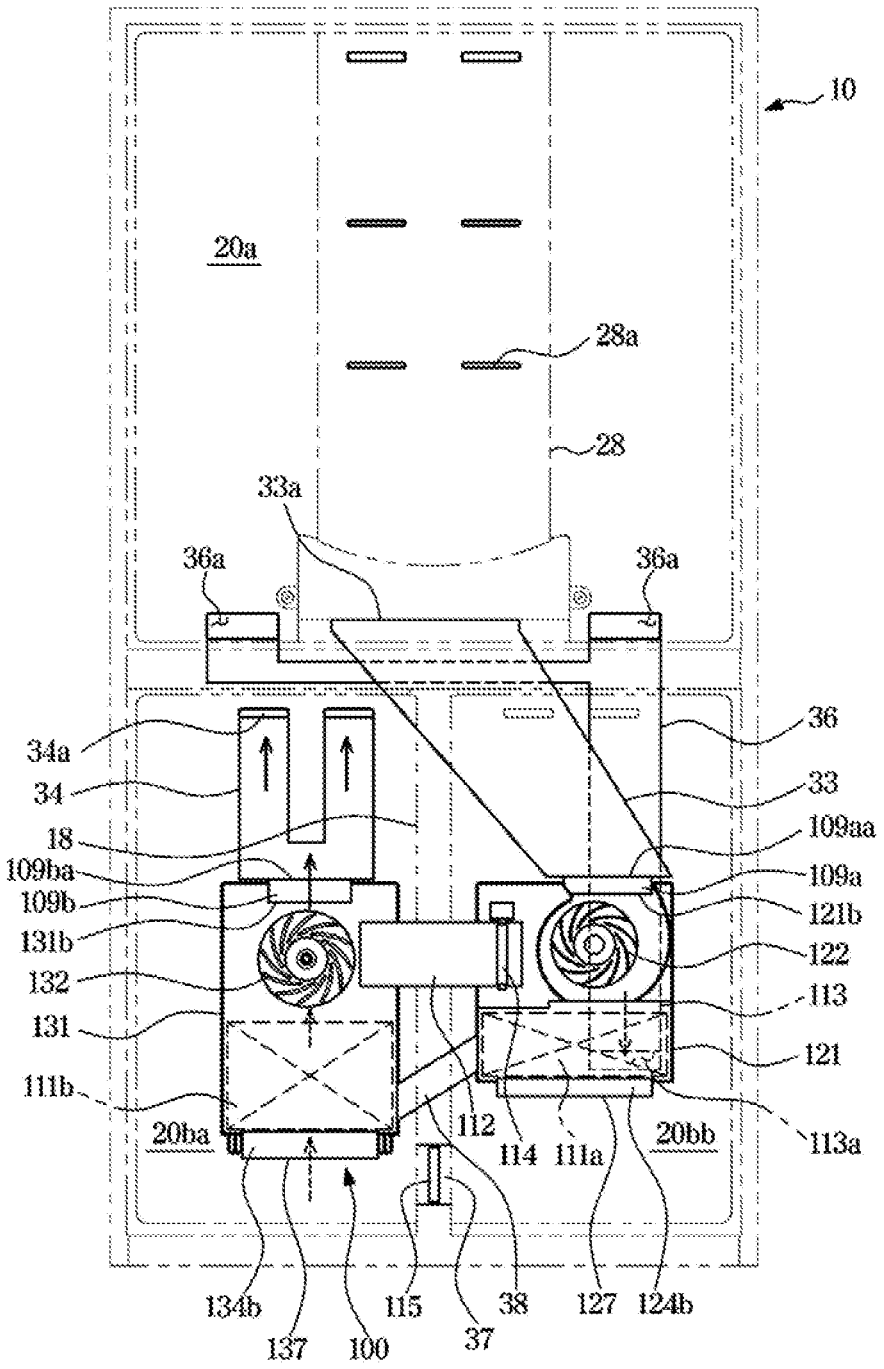
FIG. 9 is a view illustrating a flow of cold air generated by a second evaporator upon cooling a second storage compartment.
Figure 10:
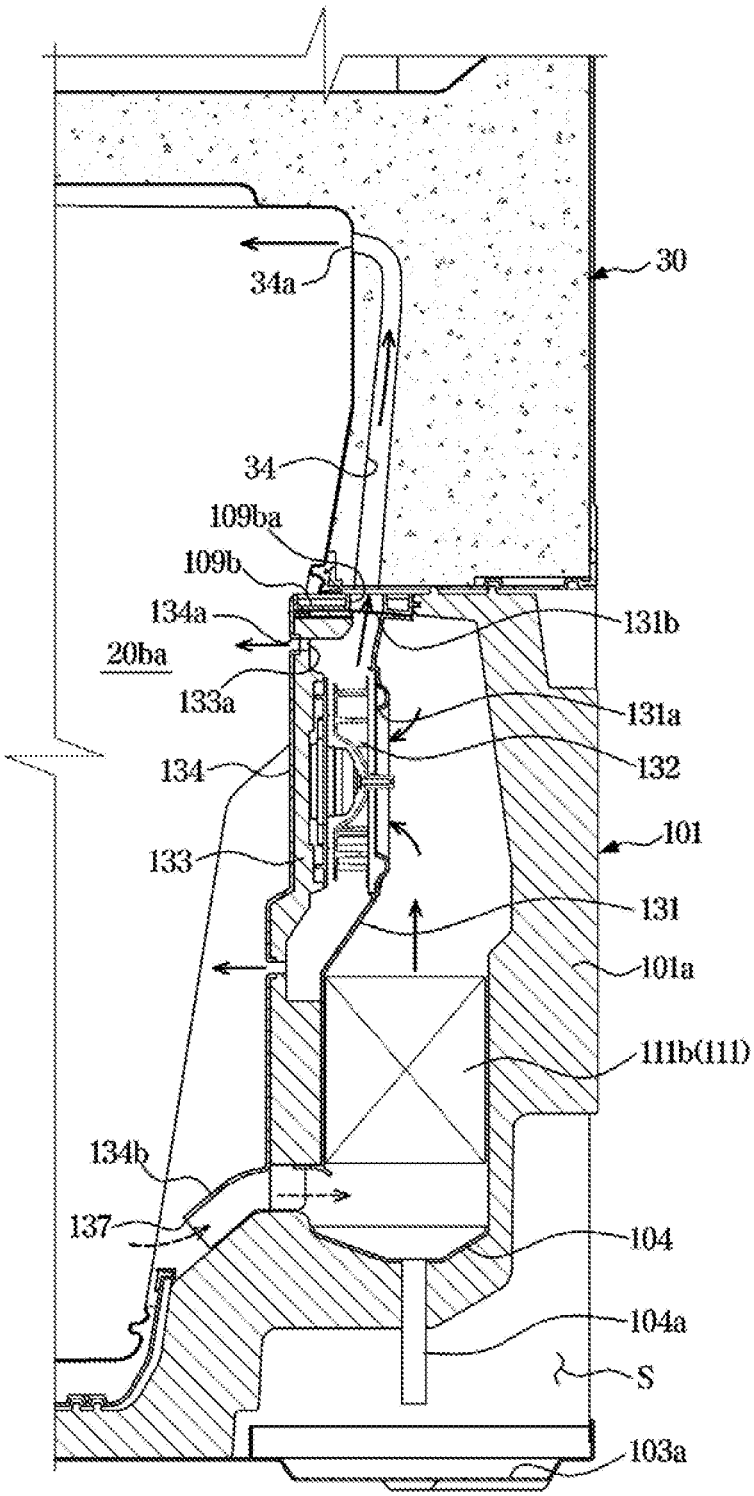
FIG. 10 is a view illustrating a flow of cold air generated by the second evaporator upon cooling the second storage compartment.
Figure 11:
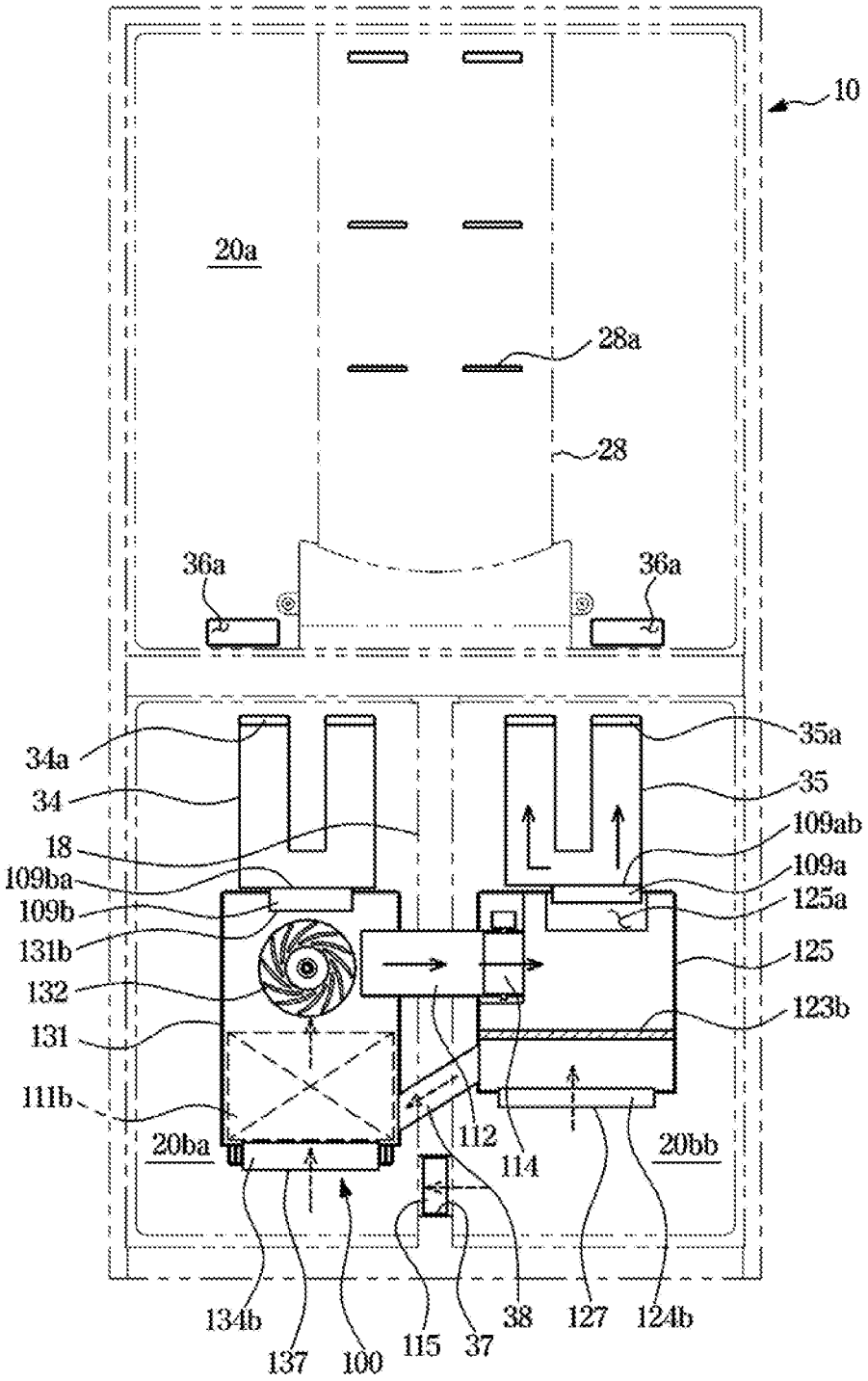
FIG. 11 is a view illustrating a flow of cold air generated by the second evaporator upon cooling a third storage compartment.
Figure 13:
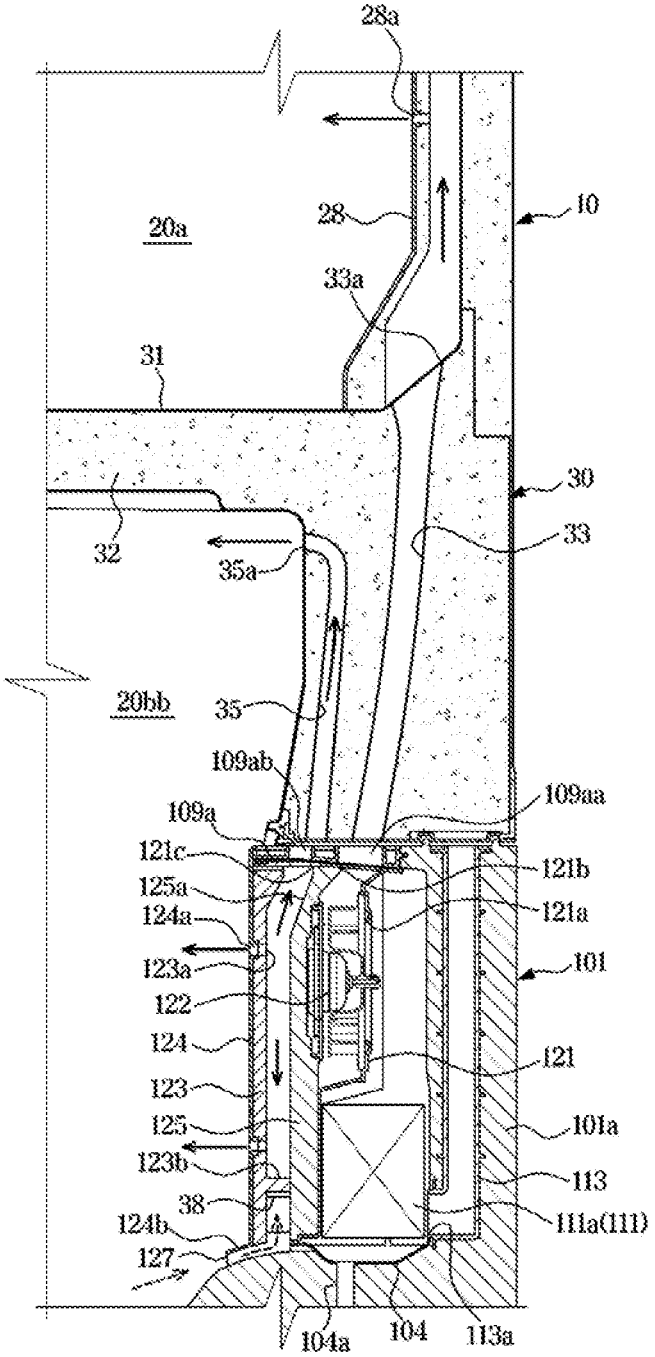
FIG. 13 is a view illustrating a flow of cold air generated by the second evaporator upon cooling the third storage compartment

FIGS. 7 and 8 are views illustrating a flow of cold air generated by a first evaporator upon cooling a first storage compartment. FIGS. 9 and 10 are views illustrating a flow of cold air generated by a second evaporator upon cooling a second storage compartment. FIGS. 11 and 13 are views illustrating a flow of cold air generated by the second evaporator upon cooling a third storage compartment. In FIG. 11, some components for cooling the first storage compartment are omitted to primarily illustrate the flow of cold air upon cooling the third storage compartment.

The flow of the cold air for cooling the first storage compartment 20*a* will be described with reference to FIGS. 7 and 8. In the intermediate body 30, the first cold air duct 33 and the first circulation duct 36 may be provided. The first cold air duct 33 may be arranged to penetrate the intermediate insulating material 32 of the intermediate body 30. The first circulation duct 36 may be arranged to penetrate the intermediate insulating material 32 of the intermediate body 30.

One end of the first cold air duct 33 may communicate with the first a (1*a*) cap hole 109*aa*. The other end of the first cold air duct 33 may communicate with the first storage compartment 20*a*. The other end of the first cold air duct 33 may be provided with a first cold air outlet 33*a*. The cold air discharged from the first cold air outlet 33*a* may be supplied to the first storage compartment 20*a* through the flow path P formed by the guide cover 28 and the inner case 120.

Particularly, the first cold air duct 33 may guide cold air, which is heat-exchanged with the first evaporator 111*a* and then blown by the first fan 122, to the first storage compartment 20*a*. The first cold air duct 33 may discharge the cold air, which is blown by the first fan 122, to the first storage compartment 20*a* through the first cold air outlet 33*a*. The cold air guided to the first storage compartment 20*a* through the first cold air duct 33 may be guided by the guide cover 28 and moved upward. The cold air may be discharged into the inside of the first storage compartment 20*a* through the guide hole 28*a* of the guide cover 28.

The first circulation duct 36 may include a first circulation inlet 36*a* communicating with the first storage compartment 20*a*. The first circulation inlet 36*a* may be provided in plural. Air, which has cooled the first storage compartment 20*a*, may be introduced into the first circulation duct 36 through the first circulation inlet 36*a*.

The first circulation duct 36 may be connected to the guide duct 113 arranged in the module body 101 of the cooling module 100. The guide duct 113 may be arranged to penetrate the module insulating material 101*a* arranged in the module body 101. Air passing through the first circulation duct 36 may flow into the guide duct 113.

The guide duct 113 may include a guide duct port 113*a* communicating with the first receiving portion 101*b*. The air passing through the guide duct 113 may be discharged to the first receiving portion 101*b* through the guide duct port 113*a*. The air discharged to the first receiving portion 101*b* may be heat-exchanged with the first evaporator 101*a*. The heat exchanged air may be discharged again to the first cold air duct 33 by the first fan 122.

Referring to FIGS. 9 and 10, the second cold air duct 34 may be provided in the intermediate body 30. The second cold air duct 34 may be arranged to penetrate the intermediate insulating material 32 of the intermediate body 30.

One end of the second cold air duct 34 may communicate with the second cap hole 109*ba*. The other end of the second cold air duct 34 may communicate with the second storage compartment 20*ba*. A second cold air outlet 34*a* may be provided at the other end of the second cold air duct 34.

The second cold air duct 34 may guide a portion of the cold air, which is heat-exchanged with the second evaporator 111*b* and then blown by the second fan 132, to the second storage compartment 20*ba*. The second cold air duct 34 may discharge a portion of the cold air, which is blown by the second fan 132, to the second storage compartment 20*ba* through the second cold air outlet 34*a*.

The other portion of the cold air, which is heat-exchanged with the second evaporator 111*b* and then blown by the second fan 132, may be discharged into the second storage compartment 20*ba* through the second cover hole 133*a* of the second fan cover 133 and the second duct hole 134*a* of the second duct cover 134.

The air, which has cooled the second storage compartment 20*ba*, may be introduced into the second receiving portion 101*c* through the second duct circulation port 137 formed by the second duct entering portion 134*b*. The air introduced into the second receiving portion 101*c* may be heat-exchanged with the second evaporator 101*b*. The heat-exchanged air may be discharged again to the second storage compartment 20*ba* by the second fan 132 through the second cold air duct 34 or discharged to the second storage compartment 20*ba* through the second cover hole 133*a* and the second duct hole 134*a*.

Figure 12:
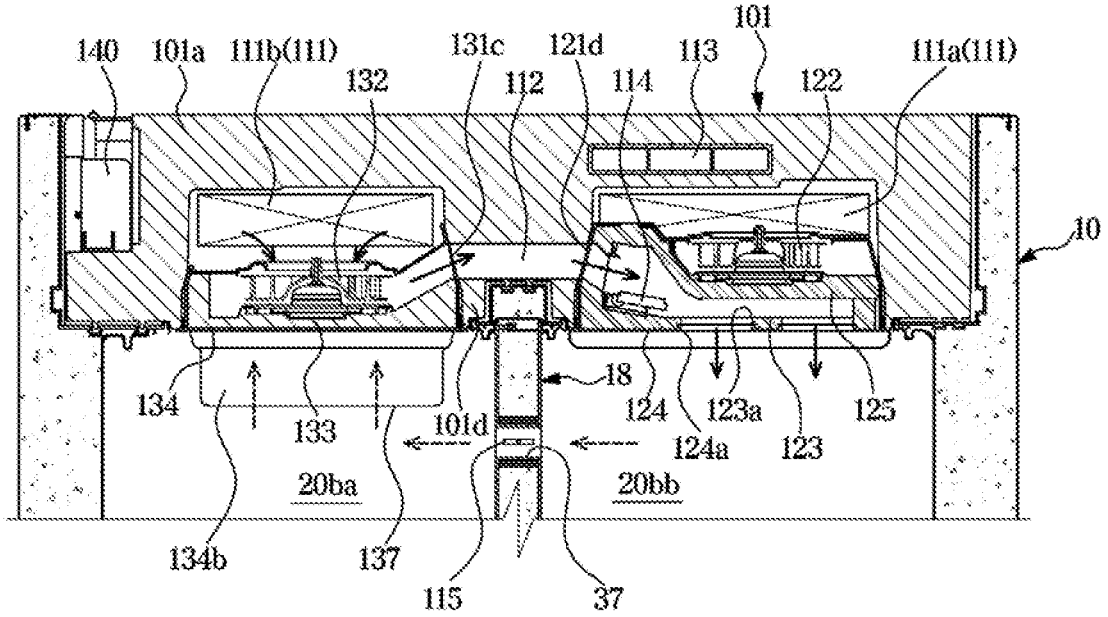
FIG. 12 is a view illustrating a flow of cold air generated by the second evaporator upon cooling the third storage compartment.

Referring to FIGS. 11 to 13, the connection duct 112, which is arranged to penetrate the partition wall 101*d* of the module body 101, may allow the first receiving portion 101*b* to communicate with the second receiving portion 101*c*. The cold air for cooling the third storage compartment 20*bb* may be provided in such a way that a portion is branched from the cold air for cooling the second storage compartment 20*ba*.

A portion of the cold air, which is heat-exchanged in the second evaporator 111*b*, is moved to the connection duct 112 by the second fan 132. Through the connection duct 112, the cold air may be moved to the space formed between the separation cover 125 and the first fan cover 115. By the separation cover 125, the cold air blown by the first fan 122 may be not mixed with the cold air blown by the second fan 132.

The cooling module 100 may include a connection duct damper 114 configured to regulate an amount of cold air passing through the connection duct 112. According to an opening degree of the connection duct damper 114, the temperature of the third storage compartment 20*bb* may be changed. FIG. 12 illustrates that the connection duct damper 114 is arranged on the first fan cover 123, but the position of the connection duct damper 114 is not limited thereto. Therefore, the connection duct damper 114 may be arranged at any position as long as regulating the amount of the cold air passing through the connection duct 112.

A portion of the cold air, which is introduced into the space between the separation cover 125 and the first fan cover 115, may be sequentially passed through the first cover hole 123*a* and the first duct hole 124*a* and then supplied to the third storage compartment 20*bb*. Another portion of the cold air, which is introduced into the space between the separation cover 125 and the first fan cover 115, may be supplied to the third storage compartment 20*bb* through the third cold air duct 35.

Particularly, the third cold air duct 35 may be provided in the intermediate body 30. The third cold air duct 35 may be arranged to penetrate the intermediate insulating material 32 of the intermediate body 30.

The third cold air duct 35 may communicate with the first b (1*b*) cap hole 109*ab*. A portion of the cold air delivered through the connection duct 112 may be sequentially passed through the first b (1*b*) fan outlet 121*c* and the first b (1*b*) cap hole 109*ab* and then introduced into the third cold air duct 35. The air passing through the third cold air duct 35 may be discharged to the third storage compartment 20*ba* through a third cold air outlet 35*a*.

A portion of the air, which has cooled the third storage compartment 20*ba*, may be moved to the second storage compartment 20*ba* through the second circulation duct 37. The second circulation duct 37 may be arranged to penetrate the separation plate 18. Through the second circulation duct 37, the air moved to the second storage compartment 20*ba* may be collected to the second receiving portion 101*c* together with the air which has cooled the second storage compartment 20*ba*.

The cooling module 100 may include a circulation duct damper 115 configured to regulate the amount of air passing through the second circulation duct 37. The temperature of the third storage compartment 20*bb* may be changed according to the opening degree of the circulation duct damper 115. The circulation duct damper 115 may be arranged in the second circulation duct 37.

Another portion of the air, which has cooled the third storage compartment 20*ba*, may be introduced into the second duct module 120 through the first duct circulation port 127. In this case, the air introduced into the second duct module 120 may pass through the space between the first fan cover 123 and the separation cover 125 and then be moved to the third circulation duct 38. The air passing through the third circulation duct 38 may be discharged to the second receiving portion 101*c* in which the second evaporator 111*b* is arranged.

With this configuration, the refrigerator 1 according to an embodiment of the disclosure may cool three storage compartments 20*a*, 20*ba*, and 20*bb* with two evaporators 111*a* and 111*b*, and thus the refrigerator 1 may have a relatively simple configuration.

Figure 14:
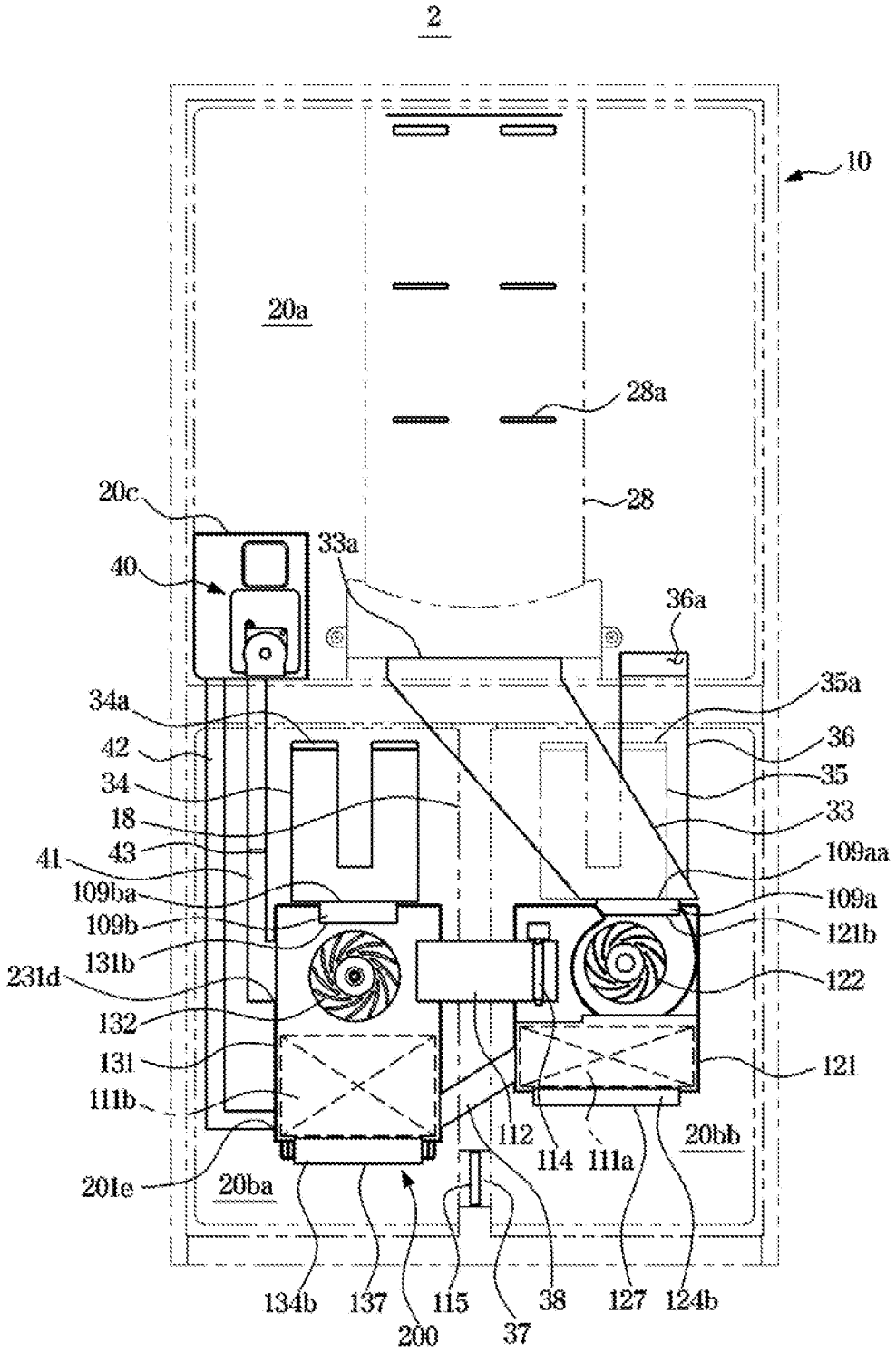
FIG. 14 is a view schematically illustrating a flow path of cold air of a refrigerator according to another embodiment of the disclosure.

FIG. 14 is a view schematically illustrating a flow path of cold air of a refrigerator according to another embodiment of the disclosure.

A flow path of cold air of a refrigerator 2 according to another embodiment of the disclosure will be described with reference to FIG. 14. The same components as those in the embodiment shown in FIGS. 1 to 13 have the same reference numerals, and detailed descriptions thereof may be omitted.

Referring to FIG. 14, the refrigerator 2 according to another embodiment of the disclosure may include an ice making compartment 20*c*. An ice maker 40 may be provided in the ice making compartment 20*c*. In FIG. 14, the ice making compartment 20*c* is arranged in the first storage compartment 20*a*. However, the position of the ice making compartment 20*c* is not limited thereto, and the ice making compartment 20*c* may be arranged in the second storage compartment 20*ba* or the third storage compartment 20*bb*.

The refrigerator 2 may include an ice making compartment cold air duct 41 configured to guide the cold air generated in a second evaporator 111*b* to the ice making compartment 20*c*. The ice making compartment cold air duct 41 may be arranged such that at least one portion thereof penetrates the cabinet 10. The ice making compartment cold air duct 41 may extend from a second fan case 131 to the ice making compartment 20*c*.

The refrigerator 2 may include an ice making compartment circulation duct 42 configured to guide air, which has cooled the ice making compartment 20*c*, to a second evaporator 111*b*. The ice making compartment circulation duct 42 may allow the ice making compartment 20*c* to communicate with a portion of a cooling module 200 in which the second evaporator 111*b* is arranged. The ice making compartment circulation duct 42 may be arranged such that at least one portion thereof penetrates the cabinet 10.

The refrigerator 2 may include an ice making compartment damper 43 configured to regulate an amount of cold air passing through the ice making compartment cold air duct 41. According to the opening degree of the ice making compartment damper 43, the temperature of the ice making compartment 20*c* may be changed. The ice making compartment damper 43 may be arranged in the ice making compartment cold air duct 41.

The cooling module 200 of the refrigerator 2 according to another embodiment of the disclosure may be provided with an ice making compartment cold air opening 231*d* communicating with the ice making compartment cold air duct 41 and an ice making compartment circulation opening 201*e* communicating with the ice making compartment circulation duct 42, and thus the cooling module 200 may cool the ice making compartment 20*c* without an additional evaporator. That is, except that the cooling module 200 shown in FIG. 12 has the ice making compartment cold air opening 231*d* and ice making compartment circulation opening 201*e*, the rest of configuration may be the same as those of the cooling module 100 shown in FIG. 4.

Figure 15:
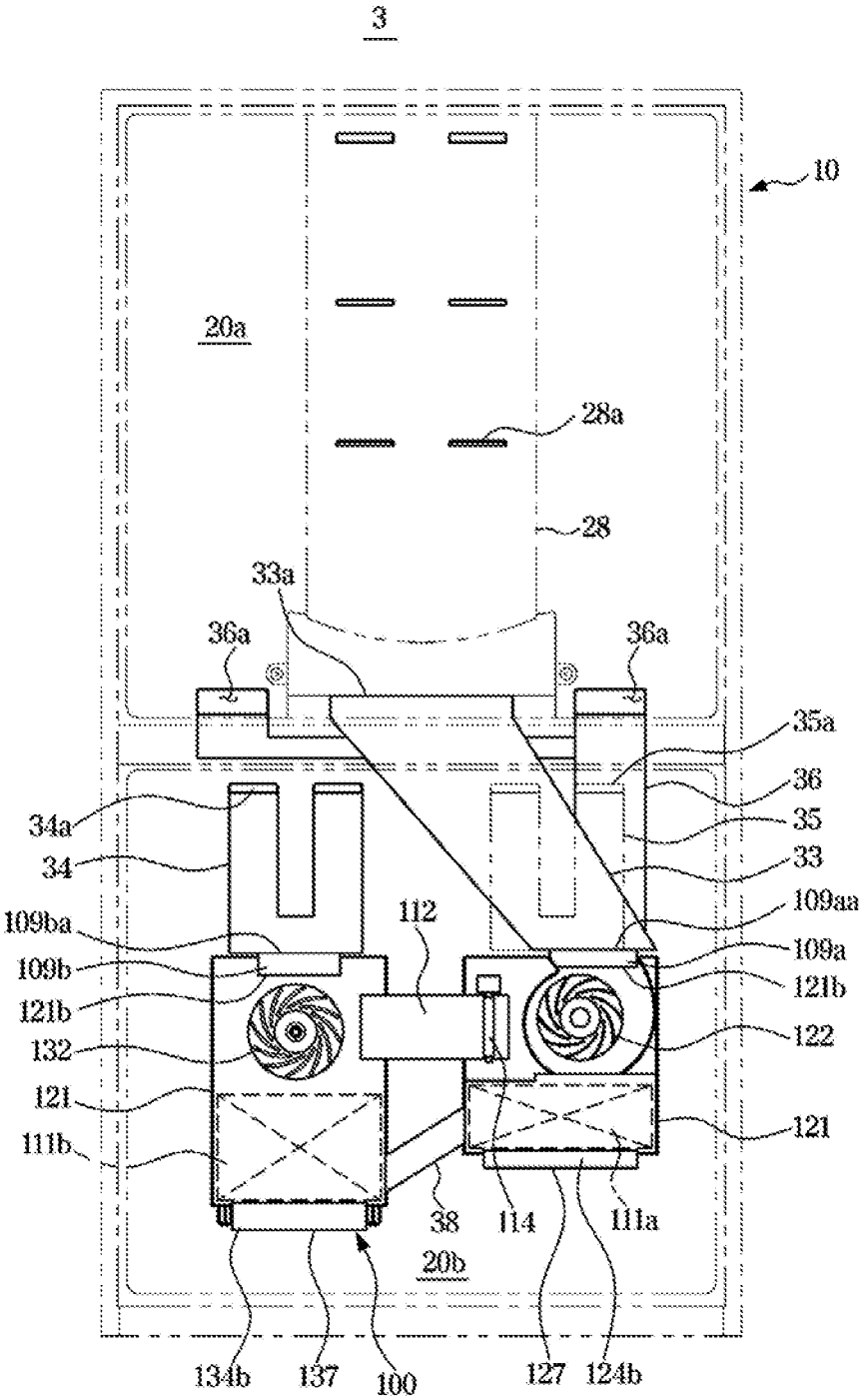
FIG. 15 is a view schematically illustrating a flow path of cold air of a refrigerator according to still another embodiment of the disclosure.

FIG. 15 is a view schematically illustrating a flow path of cold air of a refrigerator according to still another embodiment of the disclosure.

A flow path of cold air of a refrigerator 3 according to still another embodiment of the disclosure will be described with reference to FIG. 15. The same components as those in the embodiment shown in FIGS. 1 to 13 have the same reference numerals, and detailed descriptions thereof may be omitted.

Referring to FIG. 15, in the refrigerator 3 according to still another embodiment of the disclosure, the lower storage compartment 20*b* is not divided into the second storage compartment 20*ba* and the third storage compartment 20*bb*, but the lower storage compartment 20*b* may be provided as a single space. Accordingly, the separation plate 18 may be omitted in the refrigerator 3.

The cooling module 100 illustrated in FIG. 4 may be applied to the refrigerator 3 according to still another embodiment of the disclosure.

Particularly, a portion of the cold air generated by a second evaporator 111*b* may be discharged to the lower storage compartment 20*b* through a second cold air duct 34. Another portion of the cold air generated by the second evaporator 111*b* may be discharged to the lower storage compartment 20*b* through a second cover hole 133*a* and a second duct hole 134*a*.

Another portion of the cold air generated by the second evaporator 111*b* may be moved to the space between a separation cover 125 and a first fan cover 123 through a connection duct 112, as illustrated in FIGS. 11 to 13, and a portion of the air, which is moved to the space between the separation cover 125 and the first fan cover 123, may be discharged to the lower storage compartment 20*b* through a third cold air duct 35, and another portion of the air may be discharged to the lower storage compartment 20*b* through a first cover hole 123*a* and a first duct hole 124*a*. Air, which has cooled the lower storage compartment 20*b*, may be collected through a second duct circulation port 137 and/or a first duct circulation port 127.

Alternatively, the refrigerator 3 may close the connection duct damper 114 of the cooling module 100, and may allow the cold air to be discharged to the lower storage compartment 20*b* only through the second cold air duct 34, the second cover hole 133*a*, and the second duct hole 134*a*.

Although the refrigerator 3 according to still another embodiment of the disclosure has the configuration of the storage compartment slightly different from that of the refrigerator 1 shown in FIGS. 1 to 13, the cooling module 100 shown in FIGS. 1 to 13 may be applied to the refrigerator 3 without a change.

Figure 16:
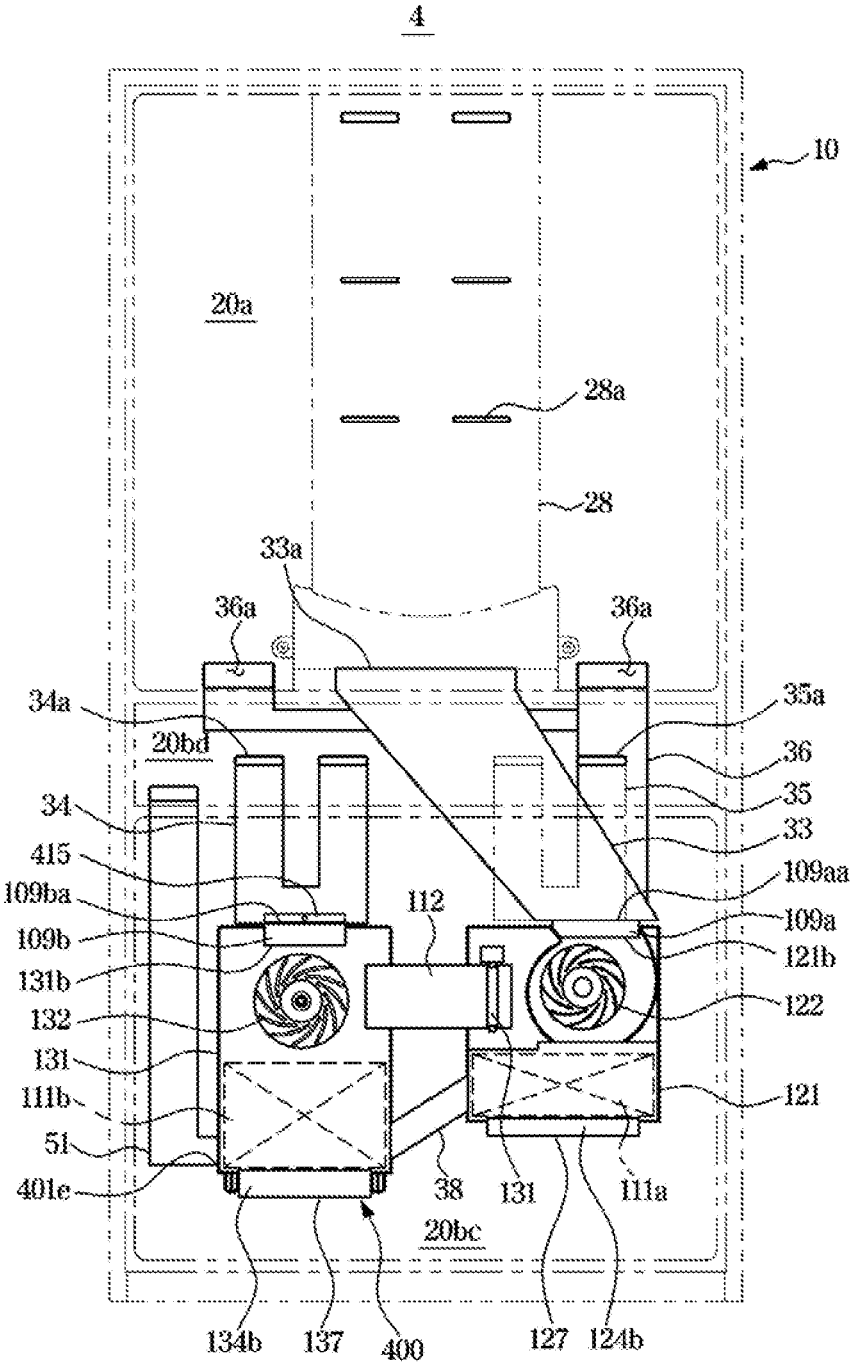
FIG. 16 is a view schematically illustrating a flow path of cold air of a refrigerator according to still another embodiment of the disclosure

FIG. 16 is a view schematically illustrating a flow path of cold air of a refrigerator according to still another embodiment of the disclosure.

A flow path of cold air of a refrigerator 4 according to still another embodiment of the disclosure will be described with reference to FIG. 16. The same components as those in the embodiment shown in FIGS. 1 to 13 have the same reference numerals, and detailed descriptions thereof may be omitted Referring to FIG. 16, the refrigerator 4 according to still another embodiment of the disclosure may be provided as a French Door Refrigerator (FDR) type. That is, as for the refrigerator 4, a lower storage compartment 20*b* may be divided into a middle compartment 20*bd* arranged below an upper storage compartment 20*a*, and a lower compartment 20*bc* arranged below the middle compartment 20*bd*.

A portion of the cold air generated by a second evaporator 111*b* may be discharged to the lower compartment 20*bc* through a second cover hole 133*a* and a second duct hole 134*a*. However, another portion of the cold air generated by the second evaporator 111*b* may be discharged to the middle compartment 20*bd* through a second cold air duct 34. That is, unlike the refrigerator 1 illustrated in FIGS. 1 to 13, the second cold air duct 34 may guide a portion of the cold air generated by the second evaporator 111*b* to the middle compartment 20*bd*.

A cooling module 400 may further include a cold air duct damper 415 arranged in the second cold air duct 34. The temperature of the middle compartment 20*bd* may be controlled according to the opening degree of the cold air duct damper 415.

The cooling module 400 may further include a third circulation duct 51 configured to collect air, which has cooled the middle compartment 20*bd*. The third circulation duct 51 may allow the middle compartment 20*bd* to communicate with a portion of the module body 101 in which a second evaporator 111*b* is arranged.

Further, another portion of the cold air generated by the second evaporator 111*b* may be moved to the space between a separation cover 125 and a first fan cover 123 through a connection duct 112, as illustrated in FIGS. 11 to 13, and a portion of the air, which is moved to the space between the separation cover 125 and the first fan cover 123, may be discharged to the middle compartment 20*bd* through a third cold air duct 35, and another portion of the air may be discharged to the lower compartment 20*bc* through a first cover hole 123*a* and a first duct hole 124*a*.

The cooling module 400 of the refrigerator 4 according to still another embodiment of the disclosure may be provided with a storage compartment circulation opening 401*e* communicating with the third circulation duct 51, and thus the cooling module 400 may cool the middle compartment 20*bd* without an additional evaporator. That is, except that the cooling module 400 shown in FIG. 16 has the storage compartment circulation opening 401*e*, the rest of configuration may be the same as those of the cooling module 100 shown in FIG. 4.

Figure 17:
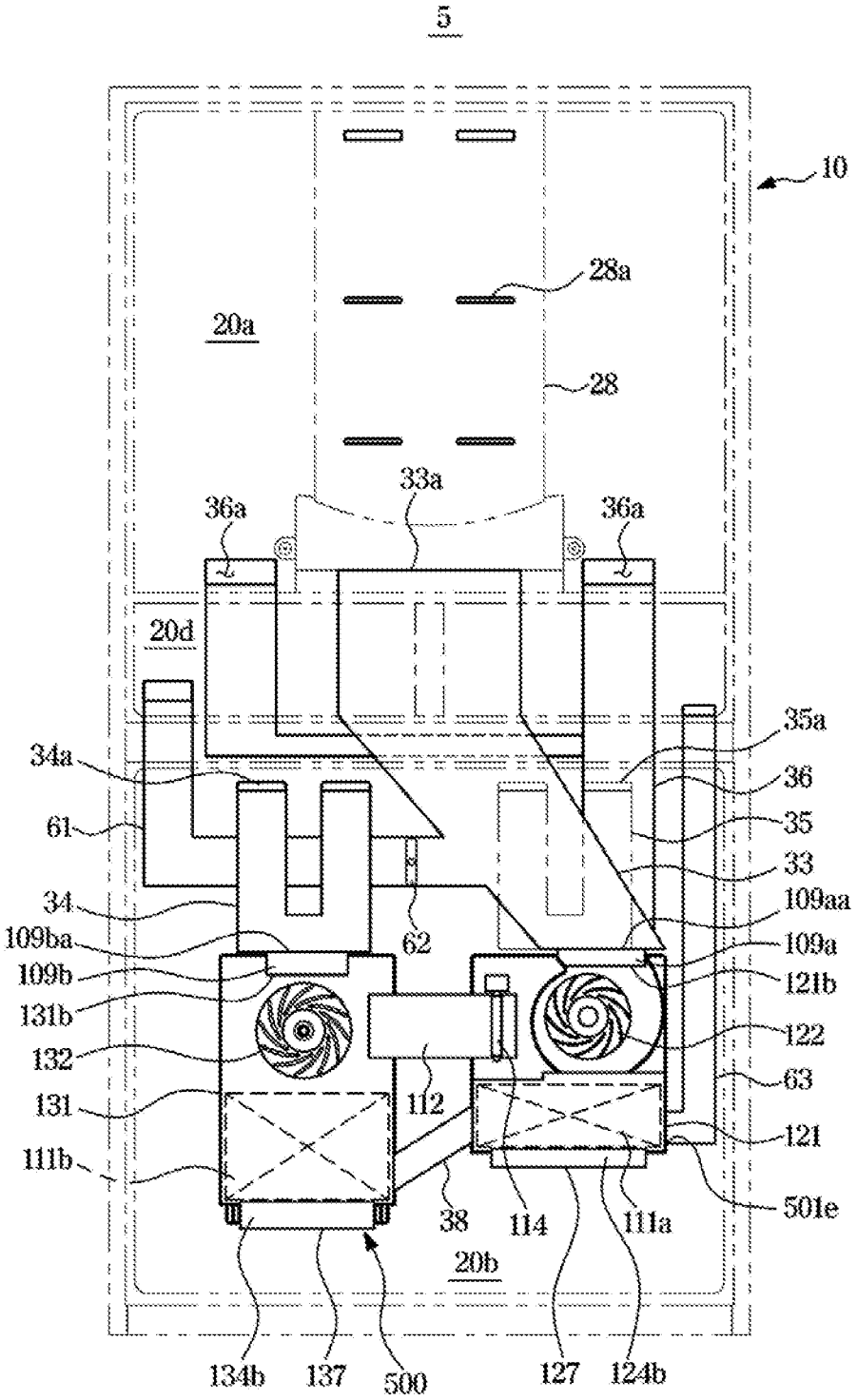
FIG. 17 is a view schematically illustrating a flow path of cold air of a refrigerator according to still another embodiment of the disclosure.

FIG. 17 is a view schematically illustrating a flow path of cold air of a refrigerator according to still another embodiment of the disclosure.

A flow path of cold air of a refrigerator 5 according to still another embodiment of the disclosure will be described with reference to FIG. 17. The same components as those in the embodiment shown in FIGS. 1 to 13 have the same reference numerals, and detailed descriptions thereof may be omitted Referring to FIG. 17, a refrigerator 5 according to another embodiment of the disclosure may include an upper storage compartment 20*a*, a lower storage compartment 20*b* and a pantry 20*d* arranged in the upper storage compartment 20*a*.

The refrigerator 5 may include a pantry cold air duct 61 configured to guide cold air to be supplied to the pantry 20*d*. The pantry cold air duct 61 may be arranged to be branched from the first cold air duct 33. The cold air generated by a first evaporator 111*a* is introduced into the first cold air duct 33, and a portion of the cold air, which is introduced into the first cold air duct 33, is moved to the upper storage compartment 20*a*, and other portion of cold air introduced into the first cold air duct 33 is moved to the pantry cold air duct 61 and then moved to the pantry 20*d*.

The refrigerator 5 may include a pantry damper 62 configured to regulate an amount of cold air flowing through the pantry cold air duct 61. According to the opening degree of the pantry damper 62, the amount of cold air supplied to the pantry 20*d* may be regulated, and thus the temperature of the pantry 20*d* may be controlled.

The refrigerator 5 may include a pantry circulation duct 63 configured to guide air, which has cooled the pantry 20*d*, to a first evaporator 111*a*. The pantry circulation duct 63 may allow the pantry 20*d* to communicate with a portion in which the first evaporator 111*a* of the cooling module 500 is arranged.

The cooling module 500 of the refrigerator 5 according to still another embodiment of the disclosure may be provided with a pantry circulation opening 501*e* communicating with the pantry circulation duct 63, and thus the cooling module 500 may cool the pantry 20*d* without an additional evaporator. That is, except that the cooling module 500 shown in FIG. 17 has the pantry circulation opening 501*e*, the rest of configuration may be the same as those of the cooling module 100 shown in FIG. 4.

Figure 18:
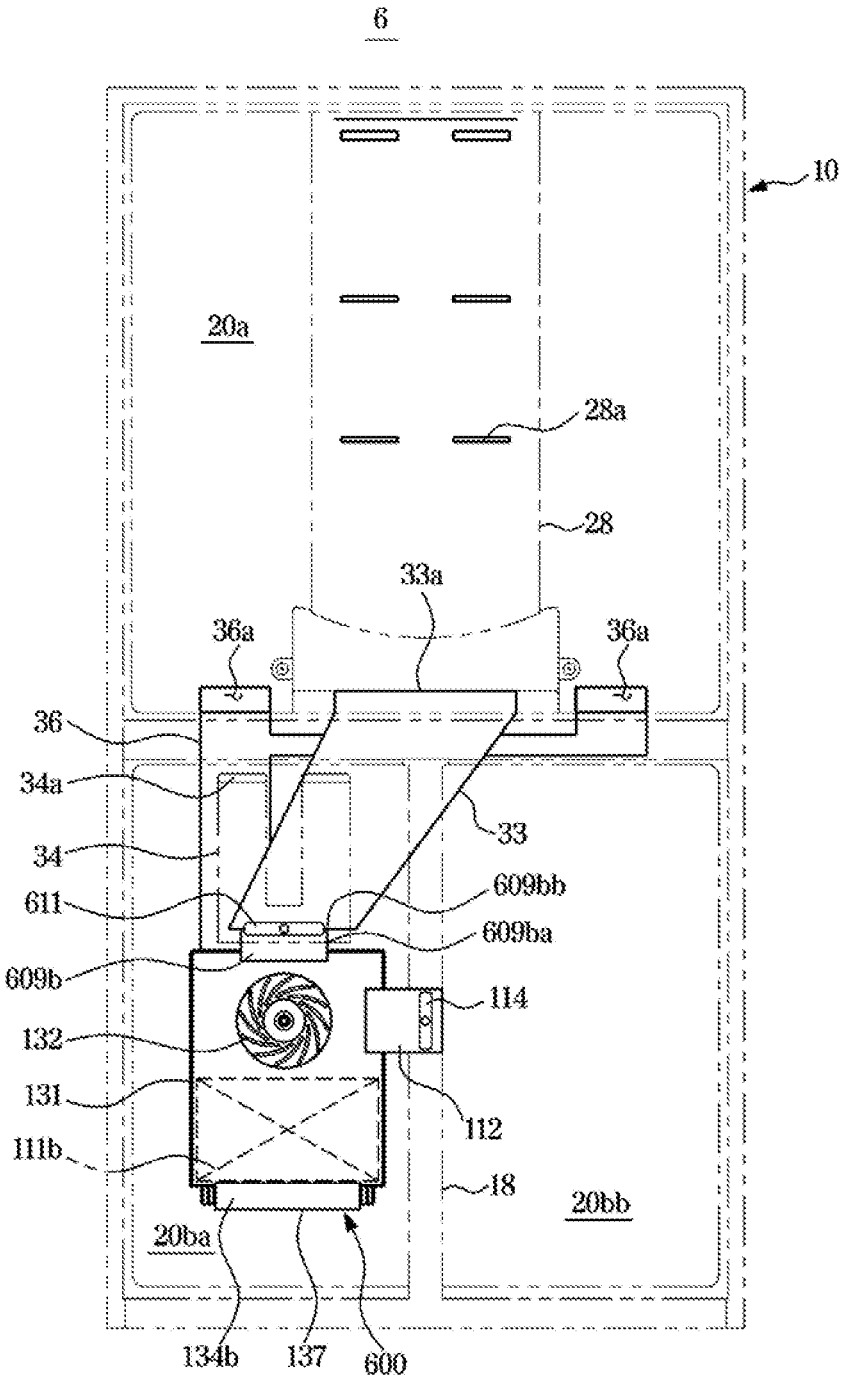
FIG. 18 is a view schematically illustrating a flow path of cold air of a refrigerator according to still another embodiment of the disclosure.

FIG. 18 is a view schematically illustrating a flow path of cold air of a refrigerator according to still another embodiment of the disclosure.

A flow path of cold air of a refrigerator 6 according to still another embodiment of the disclosure will be described with reference to FIG. 18. The same components as those in the embodiment shown in FIGS. 1 to 13 have the same reference numerals, and detailed descriptions thereof may be omitted Referring to FIG. 18, as for a cooling module 600 of the refrigerator 6 according to still another embodiment of the disclosure, the first evaporator 111*a*, the first fan 122, the first fan case 121, the separation cover 125, the first fan cover 123, and the first duct cover 124, which are contained in the cooling module 100 shown in FIG. 4, may be omitted. That is, among the components contained in the cooling module 100 illustrated in FIG. 4, the first evaporator 111*a* and components configured to guide the cold air generated by the first evaporator 111*a* may be omitted in the cooling module 600 illustrated in FIG. 18.

Particularly, the cooling module 600 of the refrigerator 6 according to still another embodiment of the disclosure may move cold air generated by a second evaporator 111*b* to a first storage compartment 20*a*, a second storage compartment 20*ba*, and a third storage compartment 20*bb*.

A portion of the cold air generated by the second evaporator 111*b* may be moved to the first cold air duct 33. The first cold air duct 33 may communicate with a second b (2*b*) cap hole 609*bb* formed in a second cap 609*b* of the cooling module 600. A cold air damper 611 may be arranged on a flow path of the cold air flowing through the first cold air duct 33. The cold air damper 611 may regulate an amount of cold air flowing through the first cold air duct 33, and thus the temperature of the first storage compartment 20*a* may be adjusted.

Another portion of the cold air generated by the second evaporator 111*b* may be moved to the second cold air duct 34. The second cold air duct 34 may communicate with a second a (2*a*) cap hole 609*ba* formed in a second cap 609*b* of the cooling module 600.

Another portion of the cold air generated by the second evaporator 111*b* may be guided to the third storage compartment 20*bb* through a connection duct 112. A connection duct damper 114 may be arranged in the connection duct 112, and as the connection duct damper 114 regulates the amount of cold air flowing through the connection duct 112, the temperature of the third storage compartment 20*bb* may be adjusted.

That is, the refrigerator 6 illustrated in FIG. 18 may cool the plurality of storage compartments 20*a*, 20*ba*, and 20*bb* by using a single evaporator 111*b*.

Figure 19:
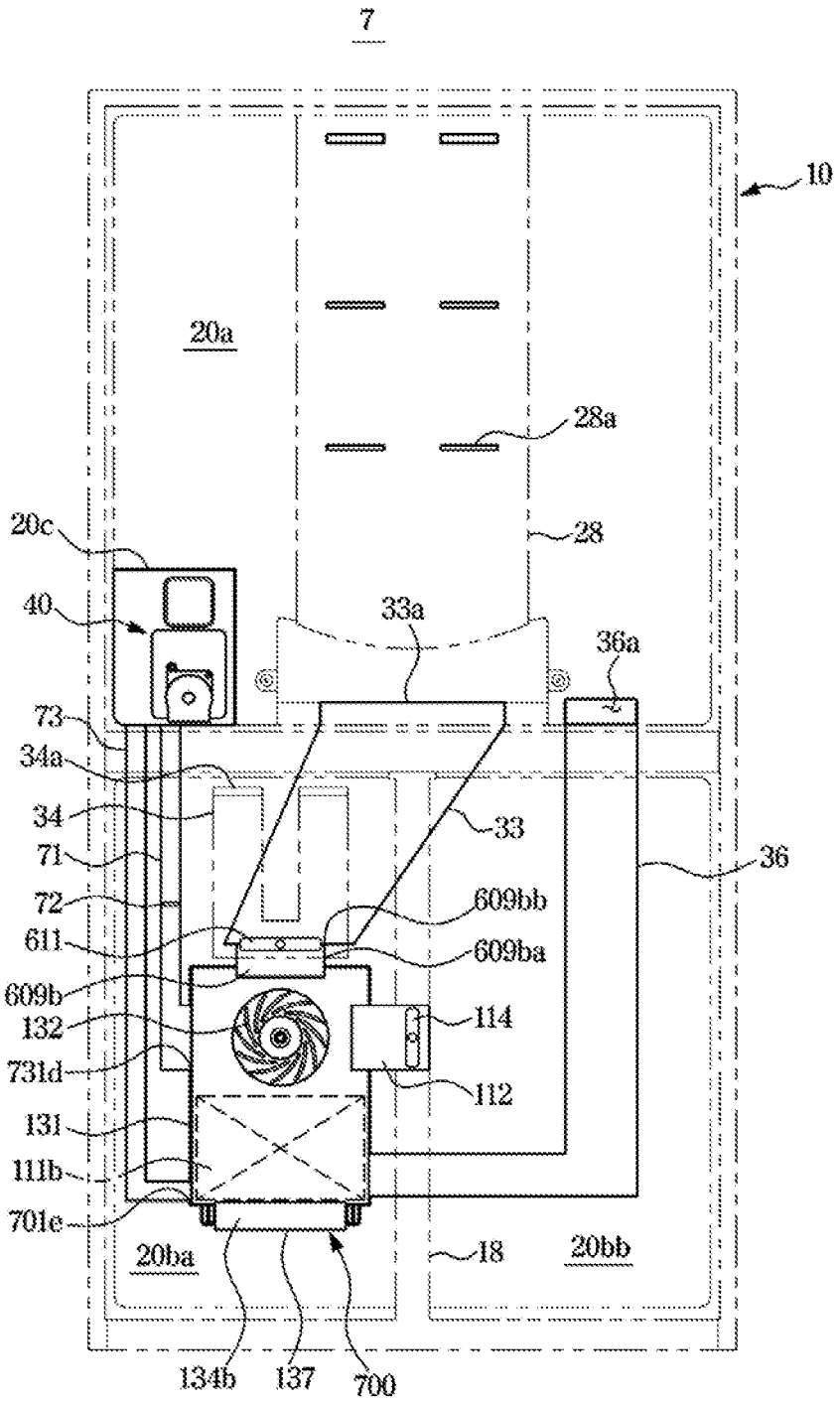
FIG. 19 is a view schematically illustrating a flow path of cold air of a refrigerator according to still another embodiment of the disclosure.

FIG. 19 is a view schematically illustrating a flow path of cold air of a refrigerator according to still another embodiment of the disclosure.

A flow path of cold air of a refrigerator 7 according to still another embodiment of the disclosure will be described with reference to FIG. 19. The same components as those in the embodiment shown in FIGS. 1 to 13 and 18 have the same reference numerals, and detailed descriptions thereof may be omitted.

Referring to FIG. 19, the refrigerator 7 according to still another embodiment of the disclosure may include an ice making compartment 20*c*. An ice maker 40 may be provided in the ice making compartment 20*c*.

In the same manner as the cooling module 600 illustrated in FIG. 18, the first evaporator 111*a* and components configured to guide the cold air generated by the first evaporator 111*a* may be omitted in the cooling module 700 illustrated in FIG. 19. In the same manner as the cooling module 600 illustrated in FIG. 18, the cooling module 700 illustrated in FIG. 19 may include a component configured to guide the cold air generated by the second evaporator 111*b* to the first storage compartment 20*a*. The cooling module 700 may include a second cap 609*b*, a second a (2*a*) cap hole 609*ba*, a second b (2*b*) cap hole 609*bb*, and a cold air damper 611.

The refrigerator 7 according to still another embodiment of the disclosure may include an ice making compartment cold air duct 71 configured to guide the cold air generated by the second evaporator 111*b* to the ice making compartment 20*c*. An ice making compartment damper 72 may be arranged on the flow path on which the cold air flows to the ice making compartment 20*c*. An amount of cold air supplied to the ice making compartment 20*c* may be regulated according to the opening degree of the ice making compartment damper 72, and accordingly, the temperature of the ice making compartment 20*c* may be adjusted.

The refrigerator 7 according to still another embodiment of the disclosure may be provided with an ice making compartment circulation duct 73 configured to guide air, which has cooled the ice-making compartment 20*c*, to the second evaporator 111*b*. The ice making compartment circulation duct 73 may allow the ice making compartment 20*c* to communicate with a portion of the cooling module 700 in which the second evaporator 111*b* is arranged.

The cooling module 700 of the refrigerator 7 according to still another embodiment of the disclosure may be provided with an ice making compartment cold air opening 731*d* communicating with the ice making compartment cold air duct 71 and an ice making compartment circulation opening 701*e* communicating with the ice making compartment circulation duct 73, and thus the cooling module 700 may cool the ice making compartment 20*c* without an additional evaporator. That is, except that the cooling module 700 shown in FIG. 19 has the ice making compartment cold air opening 731*d* and the ice making compartment circulation opening 701*e*, the rest of configuration may be the same as those of the cooling module 600 shown in FIG. 18.

Figure 20:
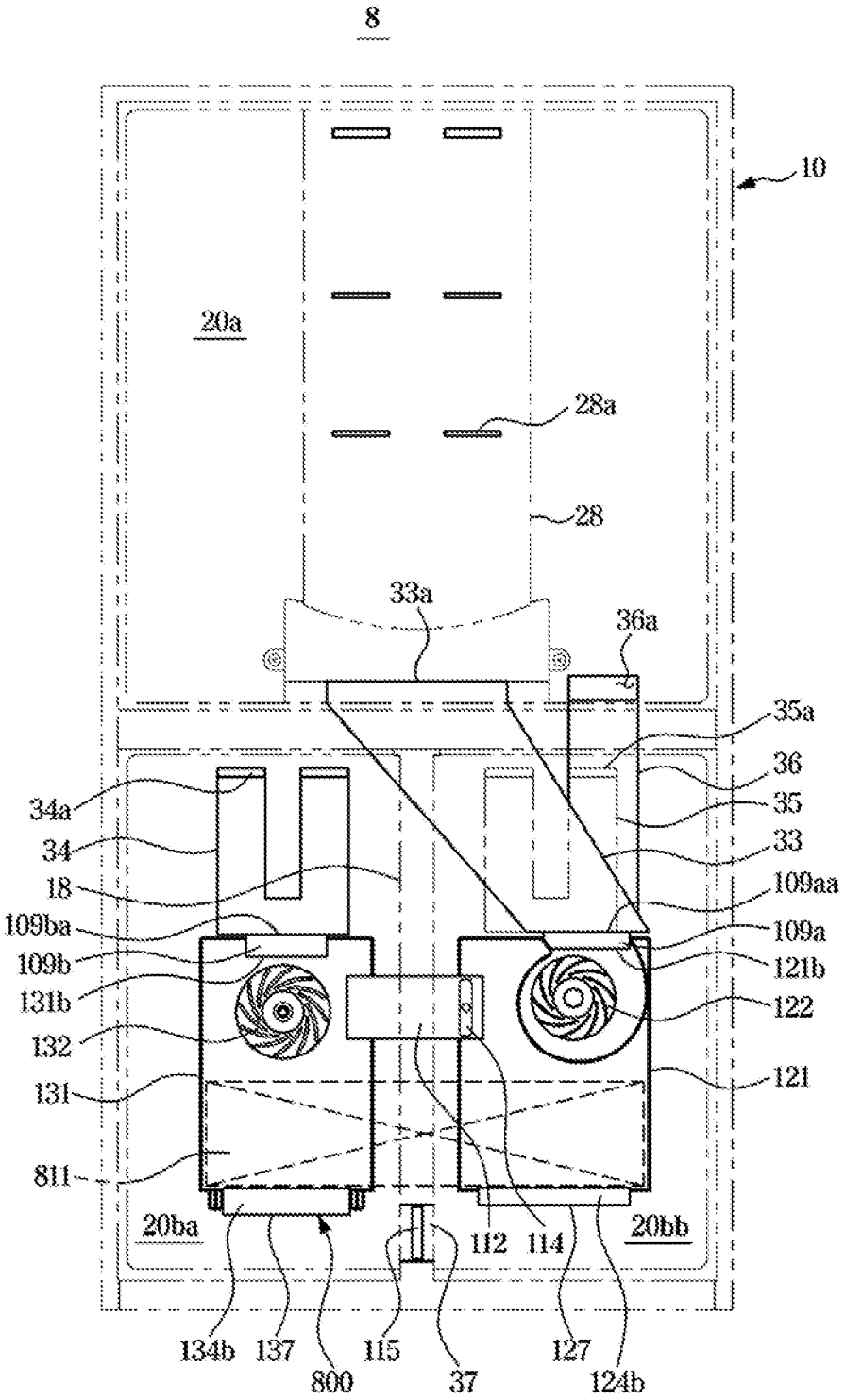
FIG. 20 is a view schematically illustrating a flow path of cold air of a refrigerator according to still another embodiment of the disclosure.

FIG. 20 is a view schematically illustrating a flow path of cold air of a refrigerator according to still another embodiment of the disclosure.

A flow path of cold air of a refrigerator 8 according to still another embodiment of the disclosure will be described with reference to FIG. 20. The same components as those in the embodiment shown in FIGS. 1 to 13 have the same reference numerals, and detailed descriptions thereof may be omitted.

Referring to FIG. 20, unlike the cooling module 100 illustrated in FIG. 4, the cooling module 800 of the refrigerator 8 according to still another embodiment of the disclosure may have a single evaporator 811. That is, unlike the cooling module 100 having the first evaporator 111*a* and the second evaporator 111*b* illustrated in FIG. 4, the cooling module 800 of the refrigerator 8 according to still another embodiment of the disclosure may include a single evaporator 811. The evaporator 811 of the cooling module 800 may be arranged to penetrate a partition wall 101*d* of a module body 101 of the cooling module 100 illustrated in FIG. 4.

A portion of the cold air generated by the evaporator 811 may be moved along the first cold air duct 33 by a first fan 122 and then supplied to the first storage compartment 20*a*.

The refrigerator 8 may regulate the amount of cold air supplied to the first storage compartment 20*a* by regulating the rotational speed of the first fan 122, and thus the refrigerator 8 may adjust the temperature of the first storage compartment 20*a*.

Another portion of the cold air generated by the evaporator 811 is moved along the second cold air duct 34 by a second fan 132 and supplied to the second storage compartment 20*ba*, or may be discharged to the second storage compartment 20*ba* through a second cover hole 133*a* and a second duct hole 134*a*.

Another portion of the cold air generated by the evaporator 811 may be sequentially passed through the connection duct 112 and the third cold air duct 35 by the second fan 132 and then supplied to a third storage compartment 20*bb*, or passed through the connection duct 112, a first cover hole 123*a*, and a first duct hole 124*a* and then supplied to the third storage compartment 20*bb*.

Figure 21:
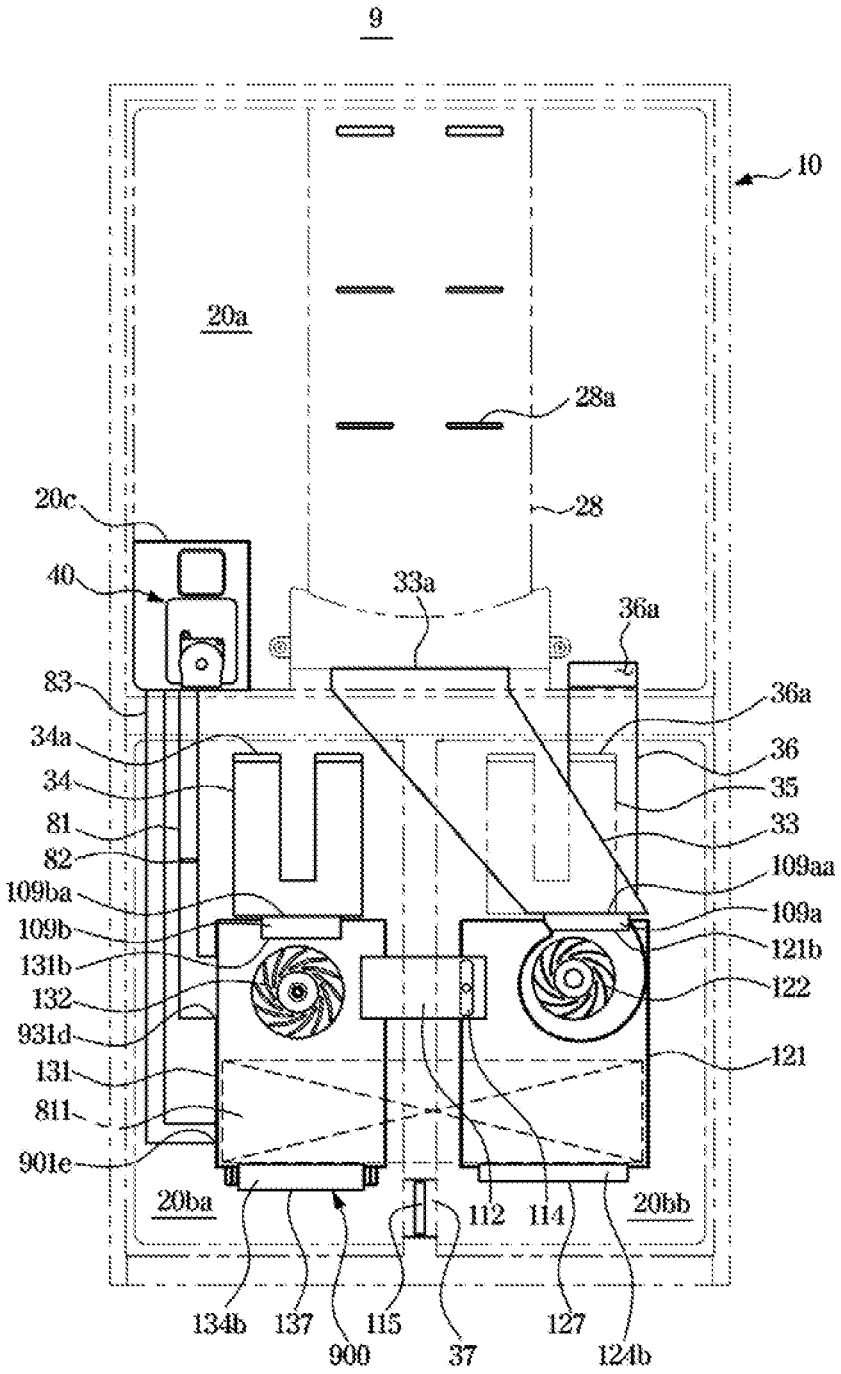
FIG. 21 is a view schematically illustrating a flow path of cold air of a refrigerator according to still another embodiment of the disclosure.

FIG. 21 is a view schematically illustrating a flow path of cold air of a refrigerator according to still another embodiment of the disclosure.

A flow path of cold air of a refrigerator 9 according to still another embodiment of the disclosure will be described with reference to FIG. 21. The same components as those in the embodiment shown in FIGS. 1 to 13 and 20 have the same reference numerals, and detailed descriptions thereof may be omitted.

Referring to FIG. 21, the refrigerator 9 according to still another embodiment of the disclosure may include an ice making compartment 20*c*. An ice maker 30 may be provided in the ice making compartment 20*c*.

Like the cooling module 800 illustrated in FIG. 20, the cooling module 900 may include the single evaporator 811.

The refrigerator 9 according to still another embodiment of the disclosure may include an ice making compartment cold air duct 81 configured to guide the cold air generated by the evaporator 811 to the ice making compartment 20*c*. An ice making compartment damper 82 may be arranged on the flow path on which the cold air moves to the ice making compartment 20*c*. An amount of cold air supplied to the ice making compartment 20*c* may be regulated according to the opening degree of the ice making compartment damper 82, and accordingly, the temperature of the ice making compartment 20*c* may be adjusted.

The refrigerator 9 according to still another embodiment of the disclosure may be provided with an ice making compartment circulation duct 83 configured to guide air, which has cooled the ice-making compartment 20*c*, to the evaporator 811. The ice making compartment circulation duct 83 may allow the ice making compartment 20*c* to communicate with a portion of the cooling module 900 in which the evaporator 811 is arranged.

The cooling module 900 of the refrigerator 9 according to still another embodiment of the disclosure may be provided with an ice making compartment cold air opening 931*d* communicating with the ice making compartment cold air duct 81 and an ice making compartment circulation opening 901*e* communicating with the ice making compartment circulation duct 83, and thus the cooling module 900 may cool the ice making compartment 20*c* without an additional evaporator. That is, except that the cooling module 900 shown in FIG. 21 has the ice making compartment cold air opening 931*d* and the ice making compartment circulation opening 901*e*, the rest of configuration may be the same as those of the cooling module 800 shown in FIG. 20.

As is apparent from the above description, it may be possible to easily maintain and repair the cold air supply system because the evaporator, together with the compressor and the condenser is mounted to the cooling module removably coupled to the cabinet.

Because the refrigerator may supply cold air to the plurality of storage compartments by using fewer evaporators than the number of storage compartments, the refrigerators may cool the plurality of storage compartments by using a relatively simple configuration.

Because the cooling module including the evaporator is removably mounted to the cabinet, it may be possible to improve the manufacturing process and improve productivity of the refrigerator.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a cabinet having a first storage compartment, a second storage compartment and a third storage compartment; and a cooling module removably coupled to the cabinet, the cooling module including an evaporator, a condenser, a compressor and first and second openings, the cabinet including:

a first cold air duct extending from the first storage compartment, coupled to the first opening in the cooling module and configured to allow a portion of the cooling module in which the evaporator is arranged, to communicate with the first storage compartment via the first opening when the cooling module is coupled to the cabinet; and a second cold air duct, different from the first cold air duct, extending from the second storage compartment, coupled to the second opening in the cooling module and configured to allow the portion of the cooling module in which the evaporator is arranged, to communicate with the second storage compartment, wherein the evaporator includes a first evaporator configured to supply cold air to the first cold air duct, and a second evaporator configured to supply cold air to the second cold air duct, wherein the cooling module further includes:

a first receiving portion in which the first evaporator is arranged;

a second receiving portion in which the second evaporator is arranged;

a partition wall arranged between the first receiving portion and the second receiving portion; and a connection duct disposed to penetrate the partition wall to form at least one portion of a flow path guiding the cold air, which is generated in the second evaporator, to the third storage compartment.

2. The refrigerator of claim 1, wherein the cooling module comprises a module body to which the evaporator is mounted and having a module insulating material.

3. The refrigerator of claim 1, wherein:

the cooling module comprises a base plate arranged below the module body, and the compressor and the condenser are mounted to the base plate.

4. The refrigerator of claim 2, wherein:

a first circulation duct is arranged to penetrate the cabinet;

a guide duct is arranged to penetrate the module body; and the first circulation duct and the guide duct allow the first storage compartment to communicate with the portion of the cooling module in which the evaporator is arranged.

5. The refrigerator of claim 2, wherein the cooling module comprises a fan configured to move cold air, which is generated in the evaporator, to at least one of the first cold air duct and the second cold air duct via the first and second openings in the cooling module when the cooling module is coupled to the cabinet.

6. The refrigerator of claim 5, wherein:

the fan comprises a first fan configured to move cold air, which is generated in the first evaporator, to the first cold air duct, and a second fan configured to move cold air, which is generated by the second evaporator, to the second cold air duct.

7. The refrigerator of claim 1, further comprising:

a connection duct damper arranged in the connection duct.

8. The refrigerator of claim 6, wherein the connection duct is arranged to penetrate the module body.

9. The refrigerator of claim 6, wherein:

the first fan is arranged in the rear of the third storage compartment; and the second fan is arranged in the rear of the second storage compartment.

10. The refrigerator of claim 9, further comprising:

a second circulation duct configured to guide air from the third storage compartment to the second storage compartment.

11. The refrigerator of claim 1, further comprising:

an ice making compartment provided inside the cabinet; and an ice making compartment cold air duct configured to guide cold air, which is generated in the second evaporator, to the ice making compartment.

12. The refrigerator of claim 11, further comprising an ice making compartment damper arranged in the ice making compartment cold air duct.

13. The refrigerator of claim 1, wherein the first cold air duct is arranged to penetrate the cabinet.

14. The refrigerator of claim 13, further comprising:

a duct cover arranged on a rear wall of the first storage compartment and configured to distribute cold air, which is supplied through the first cold air duct, to the first storage compartment.

15. A refrigerator comprising:

a cabinet having a first storage compartment, a second storage compartment, and a third storage compartment -and having a cooling module mounting portion accessible from outside the cabinet a cooling module removably coupled to the cooling module mounting portion and having a first evaporator, a second evaporator, first and second openings, a first receiving portion in which the first evaporator is arranged, and a second receiving portion in which the second evaporator is arranged the cabinet including:

a first cold air duct extending from the first storage compartment, coupled to the first opening and arranged to guide cold air, which is generated in the first evaporator, to the first storage compartment when the cooling module is coupled to the cooling module mounting portion of the cabinet;

a second cold air duct extending to the second storage compartment and different from the first cold air duct, coupled to the second opening and arranged to guide cold air, which is generated in the second evaporator, to the second storage compartment when the cooling module is coupled to the cooling module mounting portion of the cabinet; and a connection duct different from the first and second cold air ducts arranged in the module body to form at least one portion of a flow path guiding the cold air, which is generated in the second evaporator, to the third storage compartment when the cooling module is coupled to the cooling module mounting portion of the cabinet, wherein the connection duct is provided to allow the first receiving portion to communicate with the second receiving portion.

16. The refrigerator of claim 15, wherein the cooling module comprises a module body to which the first evaporator and the second evaporator are mounted and having a module insulating material arranged therein.

17. The refrigerator of claim 16, wherein the connection duct is arranged to penetrate the module body.

18. The refrigerator of claim 15, wherein the cooling module comprises a first fan configured to move cold air, which is generated in the first evaporator, to the first cold air duct via the first opening in the cooling module, and a second fan configured to move cold air, which is generated in the second evaporator, to the second cold air duct via the second opening in the cooling module and the connection duct.

19. A refrigerator comprising:

a cabinet having a first storage compartment, a second storage compartment and a third storage compartment;

a cooling module having first and second openings and comprising a first evaporator configured to generate cold air to be supplied to the first storage compartment, a second evaporator configured to generate cold air to be supplied to the second storage compartment and the third storage compartment, a first receiving portion in which the first evaporator is arranged, and a second receiving portion in which the second evaporator is arranged;

a cold air duct in the cabinet and configured to allow a portion of the cooling module, in which the first evaporator is arranged, to communicate with the first storage compartment via the first opening in the cooling module; and a connection duct arranged to form at least one portion of a flow path connecting a portion of the cooling module, in which the second evaporator is arranged, to the third storage compartment via the second opening in the cooling module, and provided to allow the first receiving portion to communicate with the second receiving portion.

* * * * *